US011479378B2

(12) United States Patent
Mitchell

(10) Patent No.: US 11,479,378 B2
(45) Date of Patent: Oct. 25, 2022

(54) STRETCH WRAPPING MACHINE WITH DISPENSE RATE CONTROL BASED ON SENSED RATE OF DISPENSED PACKAGING MATERIAL AND PREDICTED LOAD GEOMETRY

(71) Applicant: Lantech.com, LLC, Louisville, KY (US)

(72) Inventor: Michael P. Mitchell, Louisville, KY (US)

(73) Assignee: LANTECH.COM, LLC, Louisville, KY (US)

( * ) Notice: Subject to any disclaimer, the term of this patent is extended or adjusted under 35 U.S.C. 154(b) by 109 days.

(21) Appl. No.: 17/014,489

(22) Filed: Sep. 8, 2020

(65) Prior Publication Data

US 2021/0070485 A1 Mar. 11, 2021

Related U.S. Application Data

(60) Provisional application No. 62/897,505, filed on Sep. 9, 2019.

(51) Int. Cl.

| | |
|---|---|
| ***B65B 57/06*** | (2006.01) |
| ***B65B 11/02*** | (2006.01) |
| *B65B 11/00* | (2006.01) |

(52) U.S. Cl.

CPC ..... *B65B 57/06* (2013.01); *B65B 11/02* (2013.01); *B65B 2011/002* (2013.01)

(58) Field of Classification Search

CPC ..... B65B 57/04; B65B 57/06; B65B 11/02; B65B 11/045; B65B 2011/002; B65B 2210/20; B65B 2210/18

See application file for complete search history.

(56) References Cited

U.S. PATENT DOCUMENTS

| | | | |
|---|---|---|---|
| 2,076,617 | A | 4/1937 | Cleaves |
| 2,227,398 | A | 12/1940 | Mohl |
| 2,904,196 | A | 9/1959 | Teixeira |
| 3,029,571 | A | 4/1962 | Douthit |
| 3,707,658 | A | 12/1972 | Hilsenbeck |
| 3,776,081 | A | 12/1973 | Becker |
| 3,815,313 | A | 6/1974 | Heisler |
| 3,867,806 | A | 2/1975 | Lancaster, III |

(Continued)

FOREIGN PATENT DOCUMENTS

| | | |
|---|---|---|
| CA | 2277316 A1 | 1/2001 |
| CA | 3076451 | 5/2021 |

(Continued)

OTHER PUBLICATIONS

PCT International Search Report and Written Opinion for PCT International Application No. PCT/US2020/049693, dated Dec. 3, 2020.

(Continued)

*Primary Examiner* — Thomas M Wittenschlaeger

(74) *Attorney, Agent, or Firm* — Middleton Reutlinger

(57) ABSTRACT

A method, apparatus and program product control a dispense rate of a packaging material dispenser of a stretch wrapping apparatus by utilizing a combination of a sensed rate of packaging material exiting the dispenser and a predicted geometric relationship between the packaging material dispenser and the load.

48 Claims, 14 Drawing Sheets

(56) References Cited

U.S. PATENT DOCUMENTS 3,910,005 A 10/1975 Thimon et al.
4,077,179 A 3/1978 Lancaster et al.
4,079,566 A 3/1978 Stoecklin
4,152,879 A 5/1979 Shulman
4,216,640 A 8/1980 Kaufman
4,235,062 A 11/1980 Lancaster, III et al.
4,271,657 A 6/1981 Lancaster, III et al.
4,300,326 A 11/1981 Stackhouse
4,344,269 A 8/1982 Dieterlen et al.
4,387,548 A 6/1983 Lancaster et al.
4,395,255 A 7/1983 Branecky et al.
4,418,510 A 12/1983 Lancaster, III et al.
4,429,514 A 2/1984 Lancaster et al.
4,432,185 A 2/1984 Geisinger
4,458,467 A 7/1984 Shulman et al.
4,497,159 A 2/1985 Lancaster, III
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,545,182 A 10/1985 McDowell, Jr.
4,590,746 A 5/1986 Humphrey
4,628,667 A 12/1986 Humphrey et al.
4,631,898 A 12/1986 Brambilla
4,676,048 A 6/1987 Lancaster et al.
4,693,049 A 9/1987 Humphrey
4,712,354 A 12/1987 Lancaster et al.
4,716,709 A 1/1988 Lamb et al.
4,736,567 A 4/1988 Pienta
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,852,330 A 8/1989 Carangelo
4,855,924 A 8/1989 Strosser
4,862,678 A 9/1989 Humphrey
4,866,909 A 9/1989 Lancaster, III et al.
4,905,451 A 3/1990 Jaconelli et al.
4,938,008 A 7/1990 Salzsauer
4,953,336 A 9/1990 Lancaster, III et al.
4,955,176 A 9/1990 Seko et al.
4,991,381 A 2/1991 Simons
5,027,579 A 7/1991 Keip
5,040,356 A 8/1991 Thimon
5,040,359 A 8/1991 Thimon
5,054,263 A 10/1991 Maki-Rahkola et al.
5,054,987 A 10/1991 Thornton
5,077,956 A 1/1992 Thimon
5,081,824 A 1/1992 Thimon et al.
5,107,657 A 4/1992 Diehl et al.
5,123,230 A 6/1992 Upmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin-Cocher et al.
5,203,136 A 4/1993 Thimon et al.
5,203,139 A 4/1993 Salsburg et al.
5,203,671 A 4/1993 Cawley et al.
5,216,871 A 6/1993 Hannen
5,240,198 A 8/1993 Dorfel
5,301,493 A 4/1994 Chen
5,311,725 A 5/1994 Martin et al.
5,315,809 A 5/1994 Gordon et al.
5,351,461 A 10/1994 Fandard et al.
5,369,416 A 11/1994 Haverty et al.
5,414,979 A 5/1995 Moore et al.
5,447,008 A 9/1995 Martin-Cocher
5,450,711 A 9/1995 Martin-Cocher
5,463,842 A 11/1995 Lancaster
5,524,413 A 6/1996 Fukuda
5,546,730 A 8/1996 Newell et al.
5,572,855 A 11/1996 Reigrut et al.
5,581,979 A 12/1996 Scherer
5,595,042 A 1/1997 Cappi et al.
5,610,344 A 3/1997 Ueda et al.
5,634,321 A 6/1997 Martin-Cocher et al.
5,653,093 A 8/1997 Delledonne
5,671,593 A 9/1997 Ginestra et al.
5,765,344 A 6/1998 Mandeville et al.
5,768,862 A 6/1998 Mauro et al.
5,794,416 A 8/1998 Rahman
5,797,246 A 8/1998 Martin-Cocher
5,799,471 A 9/1998 Chen
5,836,140 A 11/1998 Lancaster, III
5,875,617 A 3/1999 Scherer
5,884,453 A 3/1999 Ramsey et al.
5,893,258 A 4/1999 Lancaster et al.
5,941,049 A 8/1999 Lancaster et al.
5,953,888 A 9/1999 Martin-Cocher et al.
6,082,081 A 7/2000 Mucha
6,170,228 B1 1/2001 Zeman
6,170,233 B1 1/2001 Marois et al.
6,185,900 B1 2/2001 Martin
6,195,968 B1 3/2001 Marois et al.
6,253,532 B1 7/2001 Orpen
6,293,074 B1 9/2001 Lancaster, III et al.
6,314,333 B1 11/2001 Rajala et al.
6,338,480 B1 1/2002 Endo
6,360,512 B1 3/2002 Marois et al.
6,370,839 B1 * 4/2002 Nakagawa ..... B65B 11/045 53/64
6,453,643 B1 9/2002 Buscherini et al.
6,516,591 B1 2/2003 Lancaster, III et al.
6,598,379 B2 7/2003 Zitella
6,684,612 B2 2/2004 Trottet
6,698,161 B1 3/2004 Rossi
6,748,718 B2 * 6/2004 Lancaster, III ..... B65B 11/045 53/399
6,826,893 B2 12/2004 Cere'
6,848,240 B2 2/2005 Frey
6,851,252 B2 2/2005 Maki-Rahkola et al.
6,918,225 B2 7/2005 Ours et al.
6,918,229 B2 7/2005 Lancaster, III et al.
7,040,071 B2 5/2006 Heikaus
7,114,308 B2 * 10/2006 Cox ..... B65B 11/045 53/64
7,137,233 B2 11/2006 Degrasse et al.
7,178,317 B1 2/2007 Koskela
7,386,968 B2 6/2008 Sperry et al.
7,490,823 B2 2/2009 Oishi et al.
7,540,128 B2 6/2009 Lancaster, III et al.
7,568,327 B2 8/2009 Lancaster, III et al.
7,707,801 B2 5/2010 Lancaster, III
7,707,901 B2 5/2010 Lancaster, III et al.
7,779,607 B2 * 8/2010 Lancaster, III ..... B65B 11/025 53/399
8,001,745 B2 * 8/2011 Carter ..... B65B 57/02 53/64
8,037,660 B2 10/2011 Lancaster, III et al.
8,074,431 B1 12/2011 Pierson
8,276,346 B2 10/2012 Lancaster, III et al.
8,276,354 B2 10/2012 Lancaster, III et al.
8,296,101 B1 10/2012 Barlow et al.
8,424,271 B2 4/2013 Murarotto
8,539,739 B2 9/2013 Pierson et al.
8,549,819 B1 10/2013 Bison
8,707,644 B2 4/2014 Degen et al.
8,739,502 B2 6/2014 Lancaster, III
8,772,651 B2 7/2014 Martin et al.
8,915,460 B2 12/2014 Busch et al.
9,073,210 B2 7/2015 Nakajima et al.
9,488,557 B2 * 11/2016 Lancaster, III ..... B65B 57/18
9,493,262 B2 * 11/2016 Lancaster, III ..... B65B 57/18
9,555,912 B2 * 1/2017 Cere' ..... B65B 11/045
9,896,229 B1 2/2018 Pierson et al.
10,435,191 B2 * 10/2019 Lancaster, III ..... B65B 57/16
10,676,292 B2 6/2020 Saylor
11,034,470 B2 * 6/2021 Lancaster, III ..... B65B 57/12
2001/0015057 A1 8/2001 Suolahti
2001/0017023 A1 8/2001 Armington et al.

(56) References Cited

U.S. PATENT DOCUMENTS

2002/0029540 A1 3/2002 Lancaster et al.
2003/0089081 A1 5/2003 Platon
2003/0093973 A1 5/2003 Mir
2003/0110737 A1 6/2003 Lancaster et al.
2003/0145563 A1 8/2003 Cere'
2003/0158684 A1 8/2003 Livingston
2003/0200731 A1 10/2003 Maki-Rahkola et al.
2003/0200732 A1 10/2003 Maki-Rahkola et al.
2004/0031238 A1 2/2004 Cox
2004/0040477 A1 3/2004 Neumann
2004/0060264 A1 4/2004 Miller
2004/0129150 A1 7/2004 Lancaster et al.
2004/0177592 A1 9/2004 Lancaster et al.
2004/0243277 A1 12/2004 Bonnain et al.
2005/0044812 A1 3/2005 Lancaster et al.
2005/0115202 A1 6/2005 Mertz et al.
2005/0284783 A1 12/2005 May, Jr.
2006/0028969 A1 2/2006 Kondo et al.
2006/0213155 A1 9/2006 Forni et al.
2006/0248858 A1 11/2006 Lancaster
2006/0254214 A1 11/2006 Cox et al.
2006/0254225 A1 11/2006 Lancaster et al.
2006/0289691 A1 12/2006 Forni
2007/0169442 A1 7/2007 Asiold
2007/0204564 A1 9/2007 Lancaster et al.
2007/0204565 A1 9/2007 Lancaster et al.
2007/0209324 A1 9/2007 Lancaster et al.
2008/0066431 A1 3/2008 Cousins
2008/0216449 A1 9/2008 Zimmerli
2008/0229707 A1 9/2008 Zitella et al.
2008/0229714 A1 9/2008 Zitella et al.
2008/0229716 A1 9/2008 Zitella et al.
2008/0295614 A1 12/2008 Lancaster, III et al.
2008/0307754 A1 12/2008 Storig et al.
2009/0178374 A1 7/2009 Lancaster, III et al.
2009/0235617 A1 9/2009 Moore et al.
2009/0277901 A1 11/2009 Port et al.
2009/0293425 A1 12/2009 Carter et al.
2009/0313942 A1 12/2009 Murarotto
2010/0037562 A1 2/2010 Forni et al.
2010/0107653 A1 5/2010 Paskevich et al.
2010/0126119 A1 5/2010 Ours
2010/0163443 A1 7/2010 Störig et al.
2010/0239403 A1 9/2010 Lancaster, III et al.
2010/0300049 A1 12/2010 Schmidt et al.
2010/0303526 A1 12/2010 Hayase
2010/0313525 A1 12/2010 Martin et al.
2010/0320305 A1 12/2010 Lia
2011/0131927 A1* 6/2011 Lancaster, III ..... B65B 57/04 53/64
2011/0146203 A1 6/2011 Lancaster, III et al.
2011/0153277 A1 6/2011 Morath
2011/0168751 A1 7/2011 Tsurumi
2011/0179752 A1 7/2011 Lancaster, III et al.
2012/0031053 A1 2/2012 Lancaster, III et al.
2012/0042615 A1 2/2012 Roche
2012/0102886 A1 5/2012 Lancaster, III
2012/0102887 A1 5/2012 Lancaster, III et al.
2012/0124944 A1 5/2012 Lancaster, III et al.
2012/0181368 A1 7/2012 Ekola
2013/0000252 A1 1/2013 Pettersson et al.
2013/0061558 A1 3/2013 Klear et al.
2013/0067865 A1 3/2013 Maruo
2013/0076753 A1 3/2013 Lancaster, III et al.
2013/0115971 A1 5/2013 Marti et al.
2013/0199133 A1 8/2013 Kluge et al.
2013/0247519 A1 9/2013 Clark et al.
2013/0326999 A1 12/2013 Lemieux et al.
2014/0013707 A1 1/2014 Murarotto
2014/0053502 A1 2/2014 Pecchenini
2014/0109523 A1 4/2014 Nelson
2014/0116006 A1* 5/2014 Lancaster, III ..... B65B 11/045 53/64
2014/0116007 A1* 5/2014 Lancaster, III ..... B65B 11/045 53/64
2014/0116008 A1* 5/2014 Lancaster, III ..... B65B 11/025 53/64
2014/0123605 A1* 5/2014 Cere' ..... B65B 11/025 53/461
2014/0168422 A1 6/2014 Feng et al.
2014/0208696 A1 7/2014 Phillips et al.
2014/0223863 A1 8/2014 Lancaster et al.
2014/0223864 A1 8/2014 Lancaster, III et al.
2014/0331609 A1 11/2014 Bison
2015/0096266 A1 4/2015 Divine et al.
2015/0128530 A1 5/2015 Brunson et al.
2015/0197360 A1* 7/2015 Lancaster, III ..... B65B 11/025 53/461
2015/0353220 A1 12/2015 Lancaster, III
2016/0096645 A1 4/2016 Lancaster et al.
2016/0096646 A1 4/2016 Lancaster, III
2016/0098171 A1 4/2016 Lancaster et al.
2017/0052075 A1 2/2017 Cere'
2017/0088301 A1 3/2017 Riemenschneider
2017/0327260 A1 11/2017 Lancaster
2018/0022488 A1 1/2018 Lancaster
2018/0162660 A1 6/2018 Saylor
2018/0273226 A1 8/2018 Lancaster et al.
2018/0249637 A1 9/2018 Kraus et al.
2018/0273218 A1 9/2018 Lancaster, III
2019/0002138 A1* 1/2019 Laghi ..... B65B 11/025
2020/0039673 A1 2/2020 Mitchell et al.

FOREIGN PATENT DOCUMENTS

DE 3140972 A1 6/1982
DE 3119038 A1 12/1982
DE 3634924 A1 4/1988
DE 3901704 A1 8/1990
DE 4234604 A1 4/1994
DE 19509649 9/1996
EP 0096635 A1 12/1983
EP 0144266 A2 6/1985
EP 0246659 A1 11/1987
EP 0466980 A1 1/1992
EP 0653352 A1 5/1995
EP 0671324 A1 9/1995
EP 0811554 A1 12/1997
EP 0842850 A2 5/1998
EP 1125841 A1 8/2001
EP 1213223 A1 6/2002
EP 1489004 A1 12/2004
EP 1650573 A2 4/2006
EP 1705119 A1 9/2006
EP 1717149 A1 11/2006
EP 1736426 A2 12/2006
EP 1807308 A1 7/2007
EP 1736426 A3 10/2007
EP 2183974 A1 5/2010
EP 3353062 A1 8/2018
EP 3521183 A2 8/2019
EP 3656685 5/2020
EP 3733533 11/2020
GB 1 546 523 A 5/1979
GB 2059906 A 4/1981
GB 2107668 A 5/1983
GB 2437359 A 10/2007
JP 57166252 10/1982
JP 63191707 8/1988
JP 0385209 4/1991
JP 06239311 8/1994
JP 085448 1/1996
JP 09254913 A 9/1997
JP 11165705 A 6/1999
JP 2001048111 2/2001
JP 2001072012 A 3/2001
JP 2002211503 7/2002
JP 2002362879 A1 12/2002
JP 2004161344 A 6/2004
JP 3634993 1/2005
JP 4350940 10/2009
WO WO 9107341 A1 5/1991
WO WO 9420367 A1 9/1994
WO WO 9700202 A1 1/1997

(56) References Cited

FOREIGN PATENT DOCUMENTS

| | | | |
|---|---|---|---|
| WO | WO 9822346 | A1 | 5/1998 |
| WO | WO 2004069659 | A1 | 8/2004 |
| WO | WO 2006032065 | A1 | 3/2006 |
| WO | WO 2006110596 | A1 | 10/2006 |
| WO | WO 2007071593 | A1 | 6/2007 |
| WO | WO 2007100596 | A2 | 9/2007 |
| WO | WO 2007100597 | A2 | 9/2007 |
| WO | WO 2008007189 | A2 | 1/2008 |
| WO | WO2008049148 | A1 | 5/2008 |
| WO | WO 2008115868 | A1 | 9/2008 |
| WO | WO 2008129432 | A1 | 10/2008 |
| WO | WO2010130011 | A1 | 11/2010 |
| WO | WO 2011057166 | A2 | 5/2011 |
| WO | WO 2012058549 | A2 | 5/2012 |
| WO | WO 2012058596 | A1 | 5/2012 |
| WO | WO2016057724 | | 4/2016 |
| WO | WO 2017053603 | A1 | 3/2017 |

OTHER PUBLICATIONS

"The Technology Behind a 'No-Tear', 'No-Rip' Film Carriage, and How to Explain it to your Customers," Jan. 21, 2010, downloaded from http://wulftecstretchwrapper.blogspt.com/2010_01_01archive.html on Jan. 7, 2011; 4 pages.

http://2012.modexshow.com/press/release.aspx?ref=press&id=1899, Feb. 6, 2012.

http://www.mhpn.com/product/force_anticipation_stretch_technology_for_stretch_wrappers/packaging, Nov. 23, 2012.

http://www.wulftec.com/contents/brochures/015f519c-8a1a-4a0b-81d1-727cbdcbf946.pdf. Oct. 10, 2012.

http://literature.rockwellautomation.com/idc/groups/literature/documents/ap/oem-ap069_-en-p.pdf. Aug. 1, 2011.

http://www.packworld.com/machinery/pallelizing/wulftec-international-inc-film-feeding-system-secure-product-containment_9/14/2011.

Bossier, John D., "Manual of Geospatial Science and Technology", CRC Press 2001, pp. 8-15.

Petronio,S. Going the Distance. Machine Design 76.10 (2004): 3, S8, S10, S12. (Year: 2004).

ASTM International (2008). Standard Test Methods for Vibration Testing of Shipping Containers. D999-08. (Year: 2008).

ASTM International (2009). Standard Test Methods for Programmable Horizaontal Impact Test for Shipping Containers and Systems. D4003-98. (Year: 2009).

Blumer, T., & Guadagnini, D. (2011). Shock transmissibility of a palletized load caused by forklift truck handling. Department of Industrial Technology, California Polytechnic State University . (Year:2011).

Cernokus, E. (2012). The Effect of Stretch Wrap Pre-stretch on Unitized Load Containment. M.S. Thesis, Department of Industrial Technology, California Polytechnic State University (Year: 2012).

Emblem, A. (2012). Packaging Technology—Fundamentals, Materials and Processed. Woodhead Publishing Ltd. (Year: 2012).

Crocker, Malcolm J. (2007). Handbook of Noise and Vibration Control. John Wiley & Sons. (Year: 2007).

* cited by examiner

STRETCH WRAPPING MACHINE WITH DISPENSE RATE CONTROL BASED ON SENSED RATE OF DISPENSED PACKAGING MATERIAL AND PREDICTED LOAD GEOMETRY

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

A primary metric used in the shipping industry for gauging overall wrapping effectiveness is containment force, which is generally the cumulative force exerted on the load by the packaging material wrapped around the load. Containment force depends on a number of factors, including the number of layers of packaging material, the thickness, strength and other properties of the packaging material, the amount of pre-stretch applied to the packaging material, and the wrap force or tension applied to the load while wrapping the load. An insufficient containment force can lead to undesirable shifting of a wrapped load during later transportation or handling, and may in some instances result in damaged products. On the other hand, due to environmental, cost and weight concerns, an ongoing desire exists to reduce the amount of packaging material used to wrap loads, typically through the use of thinner, and thus relatively weaker packaging materials and/or through the application of fewer layers of packaging material. As such, maintaining adequate containment forces in the presence of such concerns can be a challenge.

In particular, wrappers have historically suffered from packaging material breaks and limitations on the amount of wrap force applied to the load (as determined in part by the amount of pre-stretch used) due to erratic speed changes required to wrap loads. Were all loads perfectly cylindrical in shape and centered precisely at the center of rotation for the relative rotation, the rate at which packaging material would need to be dispensed would be constant throughout the rotation. Typical loads, however, are generally box-shaped, and have a square or rectangular cross-section in the plane of rotation, such that even in the case of square loads, the rate at which packaging material is dispensed varies throughout the rotation. In some instances, loosely wrapped loads result due to the supply of excess packaging material during portions of the wrapping cycle where the demand rate for packaging material by the load is exceeded by the rate at which the packaging material is supplied by the packaging material dispenser. In other instances, when the demand rate for packaging material by the load is greater than the supply rate of the packaging material by the packaging material dispenser, breakage of the packaging material may occur.

When wrapping a typical rectangular load, the demand for packaging material typically decreases as the packaging material approaches contact with a corner of the load and increases after contact with the corner of the load. When wrapping a tall, narrow load or a short load, the variation in the demand rate is typically even greater than in a typical rectangular load. In vertical rotating rings, high speed rotating arms, and turntable apparatuses, the variation is caused by a difference between the length and the width of the load, while in a horizontal rotating ring apparatus, the variation is caused by a difference between the height of the load (distance above the conveyor) and the width of the load. Variations in demand may make it difficult to properly wrap the load, and the problem with variations may be exacerbated when wrapping a load having one or more dimensions that may differ from one or more corresponding dimensions of a preceding load. The problem may also be exacerbated when wrapping a load having one or more dimensions that vary at one or more locations of the load itself. Furthermore, whenever a load is not centered precisely at the center of rotation of the relative rotation, the variation in the demand rate is also typically greater, as the corners and sides of even a perfectly symmetric load will be different distances away from the packaging material dispenser as they rotate past the dispenser.

The amount of force, or pull, that the packaging material exhibits on the load determines in part how tightly and securely the load is wrapped. Conventionally, this wrap force is controlled by controlling the feed or supply rate of the packaging material dispensed by the packaging material dispenser. For example, the wrap force of many conventional stretch wrapping machines is controlled by attempting to alter the supply of packaging material such that a relatively constant packaging material wrap force is maintained. With powered pre-stretching devices, changes in the force or tension of the dispensed packaging material are monitored, e.g., by using feedback mechanisms typically linked to spring loaded dancer bars, electronic load cells, or torque control devices. The changing force or tension of the packaging material caused by rotating a rectangular shaped load is transmitted back through the packaging material to some type of sensing device, which attempts to vary the speed of the motor driven dispenser to minimize the change. The passage of the corner causes the force or tension of the packaging material to increase, and the increase is typically transmitted back to an electronic load cell, spring-loaded dancer interconnected with a sensor, or to a torque control device. As the corner approaches, the force or tension of the packaging material decreases, and the reduction is transmitted back to some device that in turn reduces the packaging material supply to attempt to maintain a relatively constant wrap force or tension.

With the ever faster wrapping rates demanded by the industry, however, rotation speeds have increased significantly to a point where the concept of sensing changes in force and altering supply speed in response often loses effectiveness. The delay of response has been observed to begin to move out of phase with rotation at approximately 20 RPM. Given that a packaging dispenser is required to shift between accelerating and decelerating eight times per revolution in order to accommodate the four corners of the load, at 20 RPM the shift between acceleration and deceleration occurs at a rate of more than once every half of a second. Given also that the rotating mass of a packaging material roll and rollers in a packaging material dispenser may be 100 pounds or more, maintaining an ideal dispense rate throughout the relative rotation can be a challenge.

Also significant is the need in many applications to minimize acceleration and deceleration times for faster cycles. Initial acceleration must pull against clamped packaging material, which typically cannot stand a high force, and especially the high force of rapid acceleration, which typically cannot be maintained by the feedback mechanisms described above. As a result of these challenges, the use of high speed wrapping has often been limited to relatively lower wrap forces and pre-stretch levels where the loss of control at high speeds does not produce undesirable packaging material breaks.

Therefore, a significant need continues to exist in the art for an improved manner of reliably and efficiently controlling a wrapping machine.

SUMMARY OF THE INVENTION

The invention addresses these and other problems associated with the art by providing a method, apparatus and program product that control a dispense rate of a packaging material dispenser at least in part by utilizing a combination of a sensed rate of dispensed packaging material and a predicted geometric relationship between the packaging material dispenser and the load.

Therefore, consistent with one aspect of the invention, a method is provided for wrapping a load with packaging material using a wrapping apparatus of a type including a packaging material dispenser for dispensing packaging material to the load. The method may include generating relative rotation between the packaging material dispenser and the load about a center of rotation, sensing a rate of the packaging material exiting the packaging material dispenser, and controlling a dispense rate of the packaging material dispenser during the relative rotation based at least in part on a geometric relationship between the packaging material dispenser and a calculated location of at least one corner of the load within a plane perpendicular to the center of rotation, and further based at least in part on the sensed rate of the packaging material exiting the packaging material dispenser.

In some embodiments, the at least one corner includes a first corner, and the method further includes calculating the position of the first corner based at least in part upon one or more dimensions of the load. Also, in some embodiments, the one or more dimensions includes a length and a width. Further, in some embodiments, the one or more dimensions are input by an operator, while in some embodiments, the one or more dimensions are sensed by one or more sensors directed at the load. In addition, in some embodiments, the one or more dimensions are retrieved from a wrap profile stored in the wrapping apparatus.

In some embodiments, the one or more dimensions are based at least in part upon a standard load type representative of the load, and the one or more dimensions are determined without sensing the one or more dimensions from the load and without receiving input from an operator or a wrap profile specific to the load. In addition, in some embodiments, calculating the position of the first corner is further based at least in part upon an offset of the load from the center of rotation. Moreover, in some embodiments, the offset is based at least in part upon a standard load type representative of the load, and the offset is determined without sensing the offset from the load and without receiving input from an operator or a wrap profile specific to the load.

In some embodiments, the at least one corner of the load includes a first corner, and controlling the dispense rate of the packaging material dispenser includes determining a demand at a first rotational position about the center of rotation using a curve fit between second and third rotational positions that are respectively before and after the first rotational position about the center of rotation and for which predicted demands are determined. Moreover, in some embodiments, controlling the dispense rate of the packaging material dispenser further includes determining the predicted demands for the second and third rotational positions based at least in part upon the calculated position for the first corner. In some embodiments, the curve is a demand curve defining a demand at each of a plurality of rotational positions between the second and third rotational positions, and controlling the dispense rate further includes determining the first dispense rate by scaling a demand from the demand curve based at least in part upon a wrap force parameter. In addition, in some embodiments, the curve defines, for each of a plurality of rotational positions, a percentage of a girth of a standard load type representative of the load.

In some embodiments, the curve defines, for each of a plurality of rotational positions, a percentage of a girth of the load, where the girth of the load is based upon input of one or more dimensions of the load. Moreover, in some embodiments, the curve includes a portion of a sinusoidal curve fit between the second and third rotational positions. In addition, some embodiments may further include determining the first dispense rate at the first rotational position further by applying a rotational data shift to offset system lag. In some embodiments, the rotational data shift is variable based at least in part upon a rate of relative rotation between the packaging material dispenser and the load.

In addition, in some embodiments, the curve includes a plurality of segments spanning a full revolution about the center of rotation, each segment fit between two or more rotational positions for which predicted demands are determined. Also, in some embodiments, each segment includes a sine curve fit between two or more rotational positions for which predicted demands are determined. Moreover, in some embodiments, the plurality of segments includes eight segments, each of the eight segments spanning between a rotational position associated with a local minimum in demand and a rotational position associated with a local maximum in demand.

Further, in some embodiments, the packaging material dispenser includes a pre-stretch assembly, and sensing the rate of the packaging material exiting the packaging material dispenser includes sensing rotation of an idle roller disposed downstream of the pre-stretch assembly. Also, in some embodiments, the idle roller forms an exit point for the packaging material dispenser.

Further, in some embodiments, controlling the dispense rate of the packaging material dispenser based at least in part on the sensed rate of the packaging material exiting the packaging material dispenser includes generating a signal from the sensed rate that varies based upon an actual girth of the load at an elevation at which the packaging material dispenser is dispensing packaging material to the load. In some embodiments, controlling the dispense rate of the packaging material dispenser based at least in part on the geometric relationship between the packaging material dispenser and the calculated location of at least one corner of the load includes determining a demand at a first rotational position about the center of rotation. Also, in some embodiments, controlling the dispense rate of the packaging material dispenser based at least in part on the sensed rate of the packaging material includes scaling the determined demand based at least in part upon the generated signal.

In some embodiments, controlling the dispense rate of the packaging material dispenser based at least in part on the geometric relationship between the packaging material dispenser and the calculated location of at least one corner of the load further includes determining a percentage of girth of the load from the determined demand, and controlling the dispense rate of the packaging material dispenser based at least in part on the sensed rate of the packaging material includes scaling the generated signal by the determined percentage of girth. Further, in some embodiments, controlling the dispense rate of the packaging material dispenser based at least in part on the geometric relationship between the packaging material dispenser and the calculated location of at least one corner of the load includes generating a curve for a plurality of rotational positions about the center of rotation.

In some embodiments, the curve is a demand curve defining a demand for each of the plurality of rotational positions, and controlling the dispense rate of the packaging material dispenser based at least in part on the sensed rate of the packaging material includes scaling the curve based at least in part upon the generated signal. Further, in some embodiments, the curve is a curve defining a percentage of girth for each of the plurality of rotational positions, and controlling the dispense rate of the packaging material dispenser based at least in part on the sensed rate of the packaging material includes scaling the generated signal based at least in part upon the curve.

Also, in some embodiments, the at least one corner of the load includes a first corner, and controlling the dispense rate of the packaging material dispenser includes determining a first demand at a first rotational position about the center of rotation using the curve, and the curve is fit between second and third rotational positions that are respectively before and after the first rotational position about the center of rotation and for which predicted demands are determined.

In addition, in some embodiments, generating the signal includes sampling the sensed rate of the packaging material exiting the packaging material dispenser at a plurality of intervals and applying a filter to the samples. In some embodiments, generating the signal includes sampling the sensed rate of the packaging material exiting the packaging material dispenser at a plurality of intervals and, at each interval, summing a first percentage of the sampled sense rate with a second percentage of value calculated during a prior interval.

Consistent with another aspect of the invention, a method may be provided for wrapping a load with packaging material using a wrapping apparatus of the type including a packaging material dispenser for dispensing packaging material to the load. The method may include generating relative rotation between the packaging material dispenser and the load about a center of rotation, sensing a rate of the packaging material exiting the packaging material dispenser, and controlling a dispense rate of the packaging material dispenser during the relative rotation. Controlling the dispense rate includes generating a curve that varies over at least a portion of a relative revolution about the center of rotation based at least in part upon one or more dimensions of the load within a plane perpendicular to the center of rotation, at a first rotational position, generating a dispenser control signal by combining a value of the curve corresponding to the first rotational position with the sensed rate of the packaging material exiting the packaging material dispenser, and using the dispenser control signal to control the dispense rate of the packaging material dispenser.

In addition, in some embodiments, the curve defines a plurality of values each representing a percentage of a girth of the load at an associated rotational position, and where combining the value of the curve corresponding to the first rotational position with the sensed rate of the packaging material exiting the packaging material dispenser includes scaling the sensed rate of the packaging material exiting the packaging material dispenser by the value of the curve corresponding to the first rotational position. In addition, some embodiments may further include generating the sensed rate of the packaging material exiting the packaging material dispenser by sampling a rate of rotation of an encoder coupled to an idle roller downstream of a pre-stretch assembly of the packaging material dispenser at each of a plurality of intervals and averaging sampled rates captured over multiple intervals.

In addition, in some embodiments, controlling the dispense rate further includes applying a wrap force parameter such that the dispenser control signal is scaled by the wrap force parameter. In some embodiments, controlling the dispense rate further includes applying a rotational data shift such that the dispenser control signal is shifted to offset system lag.

Consistent with another aspect of the invention, a method may be provided for wrapping a load with packaging material using a wrapping apparatus of the type including a packaging material dispenser for dispensing packaging material to the load during relative rotation between the packaging material dispenser and the load about a center of rotation. The method may include, prior to initiating a wrap cycle for the load, receiving operator input specifying one or more dimensions of the load within a plane perpendicular to the center of rotation, determining a wrap model for the load based upon the one or more dimensions specified by the received operator input, the wrap model being representative of a demand for the packaging material dispenser over at least a portion of a revolution between the packaging material dispenser and the load based upon the one or more dimensions specified by the received operator input, initiating the wrap cycle for the load and generating relative rotation between the packaging material dispenser and the load about the center of rotation, sensing a rate of the packaging material exiting the packaging material dispenser with a sensor during the relative rotation and generating a signal representative thereof, and controlling the dispense rate of the packaging material dispenser during the relative rotation by scaling the generated signal at a first rotational position based upon the wrap model.

Further, in some embodiments, the wrap model represents demand in terms of percentage of load girth over the at least a portion of the revolution. In addition, in some embodiments, the wrap model defines a curve including a plurality of values, each representing a percentage of a girth of the load at an associated rotational position, and scaling the generated signal at the first rotational position based upon the wrap model includes scaling the generated signal by the value of the curve corresponding to the first rotational position. Some embodiments may further include generating the signal by sampling a rate of rotation of an encoder coupled to an idle roller downstream of a pre-stretch assembly of the packaging material dispenser at each of a plurality of intervals and averaging sampled rates captured over multiple intervals.

Moreover, in some embodiments, controlling the dispense rate further includes applying a wrap force parameter such that the dispense rate is scaled by the wrap force parameter. Further, in some embodiments, controlling the dispense rate further includes applying a rotational data shift such that the dispense rate is shifted to offset system lag.

Some embodiments may also include an apparatus for wrapping a load with packaging material including a packaging material dispenser for dispensing packaging material to the load, a rotational drive configured to generate relative rotation between the packaging material dispenser and the load about a center of rotation, and a controller coupled to the packaging material dispenser and the rotational drive and configured to perform any of the aforementioned methods. Similarly, some embodiments may include a program product including a computer readable medium, and program code configured upon execution by a controller in an apparatus that wraps a load with packaging material using a packaging material dispenser adapted for relative rotation with the load about a center of rotation, with the program code configured to perform any of the aforementioned methods.

Consistent with another aspect of the invention, an apparatus for wrapping a load with packaging material may include a packaging material dispenser for dispensing packaging material to the load, the packaging material dispenser including a pre-stretch assembly and an idle roller downstream of the pre-stretch assembly, a rotational drive configured to generate relative rotation between the packaging material dispenser and the load about a center of rotation, an encoder configured to sense rotation of the idle roller and output a signal representative thereof, and a controller coupled to the packaging material dispenser, the rotational drive and the sensor. The controller may be configured to control a dispense rate of the packaging material dispenser during the relative rotation by generating a filtered rate signal at least in part by averaging together a plurality of samples of the encoder signal, and scaling the filtered rate signal by a value determined based at least in part on a geometric relationship between the packaging material dispenser and a calculated location of at least one corner of the load within a plane perpendicular to the center of rotation.

In some embodiments, the controller is further configured to determine the value by accessing a wrap model that defines a curve representative of a demand for the packaging material dispenser over at least a portion of a revolution between the packaging material dispenser and the load based upon one or more dimensions of the load. Moreover, in some embodiments, the wrap model represents demand in terms of percentage of load girth over the at least a portion of the revolution. Further, in some embodiments, the wrap model includes a rotational data shift to offset system lag. In addition, in some embodiments, the controller is further configured to control the dispense rate further by applying a wrap force parameter such that the dispense rate is scaled by the wrap force parameter.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention may control a dispense rate of a packaging material dispenser utilizing a combination of a sensed rate of packaging material exiting the dispenser and a predicted geometric relationship between the packaging material dispenser and the load. As will become more apparent below, in some embodiments, the geometry of the load may be used to predict the location of a corner of the load and generate therefrom a first input used to generate a dispense rate signal used to control the dispense rate of a packaging material dispenser. The first input may also be based upon other factors in some embodiments, e.g., based upon curve fitting and/or a rotational data shift. In addition, a sensor may be used to sense the rate of packaging material exiting the dispenser during wrapping to generate a second input for use in generating the dispense rate signal. The first and second inputs may be combined, e.g., also in combination with a wrap force parameter, to control the rate at which packaging material is dispensed by the packaging material dispenser.

Prior to a further discussion of these various techniques, however, a brief discussion of various types of wrapping apparatus within which the various techniques disclosed herein may be implemented is provided.

Wrapping Apparatus Configurations

Figure 1:
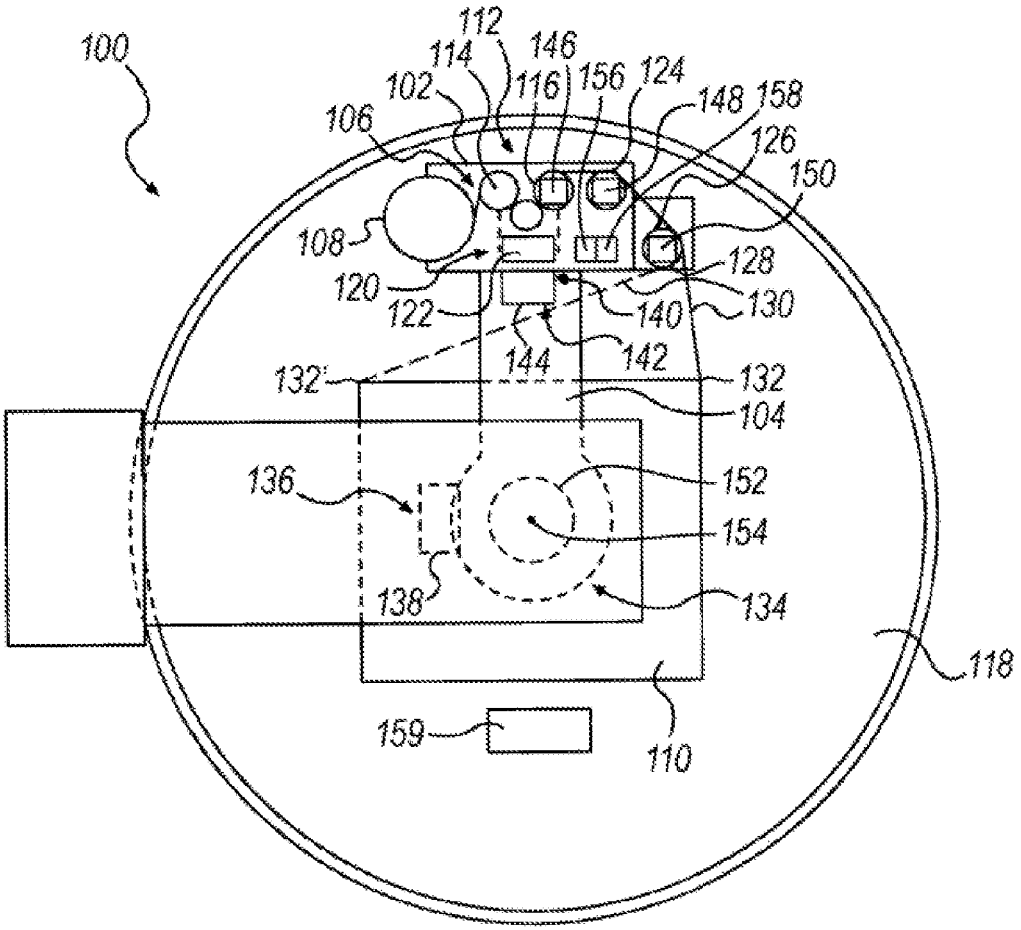
FIG. 1 shows a top view of a rotating arm-type wrapping apparatus consistent with the invention.

Various wrapping apparatus configurations may be used in various embodiments of the invention. For example, FIG. 1 illustrates a rotating arm-type wrapping apparatus 100, which includes a roll carriage or elevator 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114. Moreover, in some embodiments the roll of packaging material 108 may be undriven and may rotate freely, while in other embodiments the roll may be driven, e.g., by biasing a surface of the roll against upstream dispensing roller 114 or another driven roller, or by driving the roll directly.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions. In other embodiments, however, packaging material dispenser 106 may be driven proportionally to the relative rotation, or alternatively, tension in the packaging material extending between the packaging material dispenser and the load may be used to drive the packaging material dispenser.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, generally in a direction parallel to an axis of rotation between the packaging material dispenser 106 and load 110 and load support surface 118. For example, for wrapping apparatus 100, lift drive system 142 may drive roll carriage 102 and packaging material dispenser 106 upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount, rate and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154. Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships. In some embodiments, for example, one or more rotational positions may be sensed (e.g., even just a single home position in some embodiments), and other rotational positions may be predicted based upon a predicted time to reach those other rotational positions given a current rate of relative rotation. Other sensors may also be used to determine the height and/or other dimensions of a load, among other information.

Additional sensors, such as a load distance sensor 156 and/or a film angle sensor 158, may also be provided on wrapping apparatus 100. Load distance sensor 156 may be used to measure a distance from a reference point to a surface of load 110 as the load rotates relative to packaging material dispenser 106 and thereby determine a cross-sectional dimension of the load at a predetermined angular position relative to the packaging material dispenser. In one embodiment, load distance sensor 156 measures distance along a radial from center of rotation 154, and based on the known, fixed distance between the sensor and the center of rotation, the dimension of the load may be determined by subtracting the sensed distance from this fixed distance. Sensor 156 may be implemented using various types of distance sensors, e.g., a photoeye, proximity detector, laser distance measurer, ultrasonic distance measurer, electronic rangefinder, and/or any other suitable distance measuring device. Exemplary distance measuring devices may include, for example, an IFM Effector 01D100 and a Sick UM30-213118 (6036923).

Film angle sensor 158 may be used to determine a film angle for portion 130 of packaging material 108, which may be relative, for example, to a radial (not shown in FIG. 1) extending from center of rotation 154 to exit point 128 (although other reference lines may be used in the alternative). In one embodiment, film angle sensor 158 may be implemented using a distance sensor, e.g., a photoeye, proximity detector, laser distance measurer, ultrasonic distance measurer, electronic rangefinder, and/or any other suitable distance measuring device. In one embodiment, an IFM Effector 01D100 and a Sick UM30-213118 (6036923) may be used for film angle sensor 158. In other embodiments, film angle sensor 158 may be implemented mechanically, e.g., using a cantilevered or rockered follower arm having a free end that rides along the surface of portion 130 of packaging material 108 such that movement of the follower arm tracks movement of the packaging material. In still other embodiments, a film angle sensor may be implemented by a force sensor that senses force changes resulting from movement of portion 130 through a range of film angles, or a sensor array (e.g., an image sensor) that is positioned above or below the plane of portion 130 to sense an edge of the packaging material.

Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
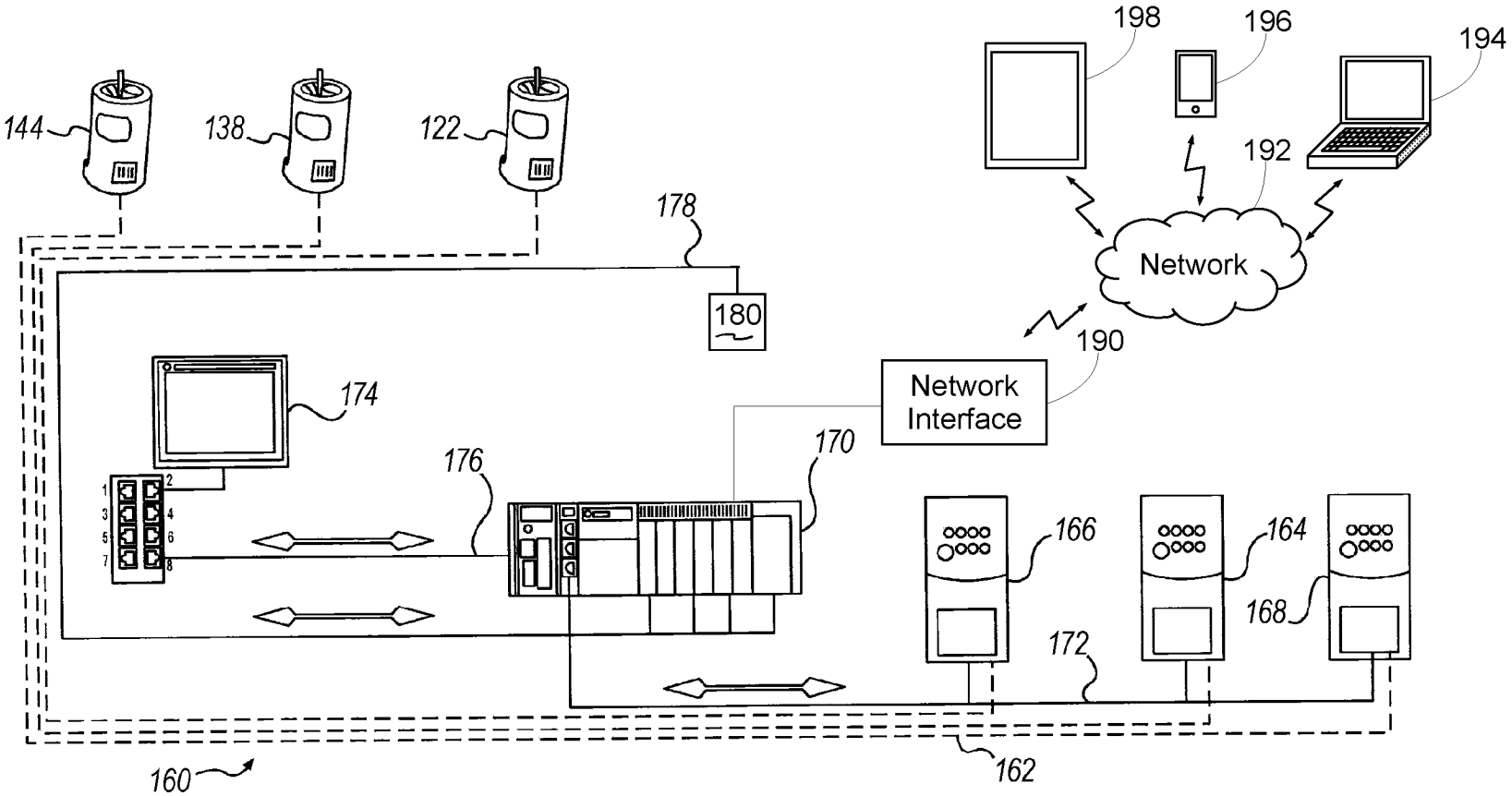
FIG. 2 is a schematic view of an example control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors 180 (e.g., one or more of sensors 146, 148, 150, 152, 156 and 158, among others) through a data link 178 to allow controller 170 to receive feedback and/or performance-related data during wrapping, such as roller and/or drive rotation speeds, load dimensional data, etc. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user or other input, converting the input into control variables for controlling a wrap operation, initiating and implementing a wrap operation based upon the control variables, providing feedback to a user, etc., may be implemented by various local and/or remote components and combinations thereof in different embodiments. In some embodiments, for example, an external device such as a mobile device, a networked computer, a server, a cloud service, etc. may generate a wrap model that defines the control variables for controlling a wrap operation for a particular load, and that wrap model may then be communicated to a wrapping apparatus and used by a controller therefor to control a dispense rate during a wrap operation. As such, the invention is not limited to the particular allocation of functionality described herein.

Figure 3:
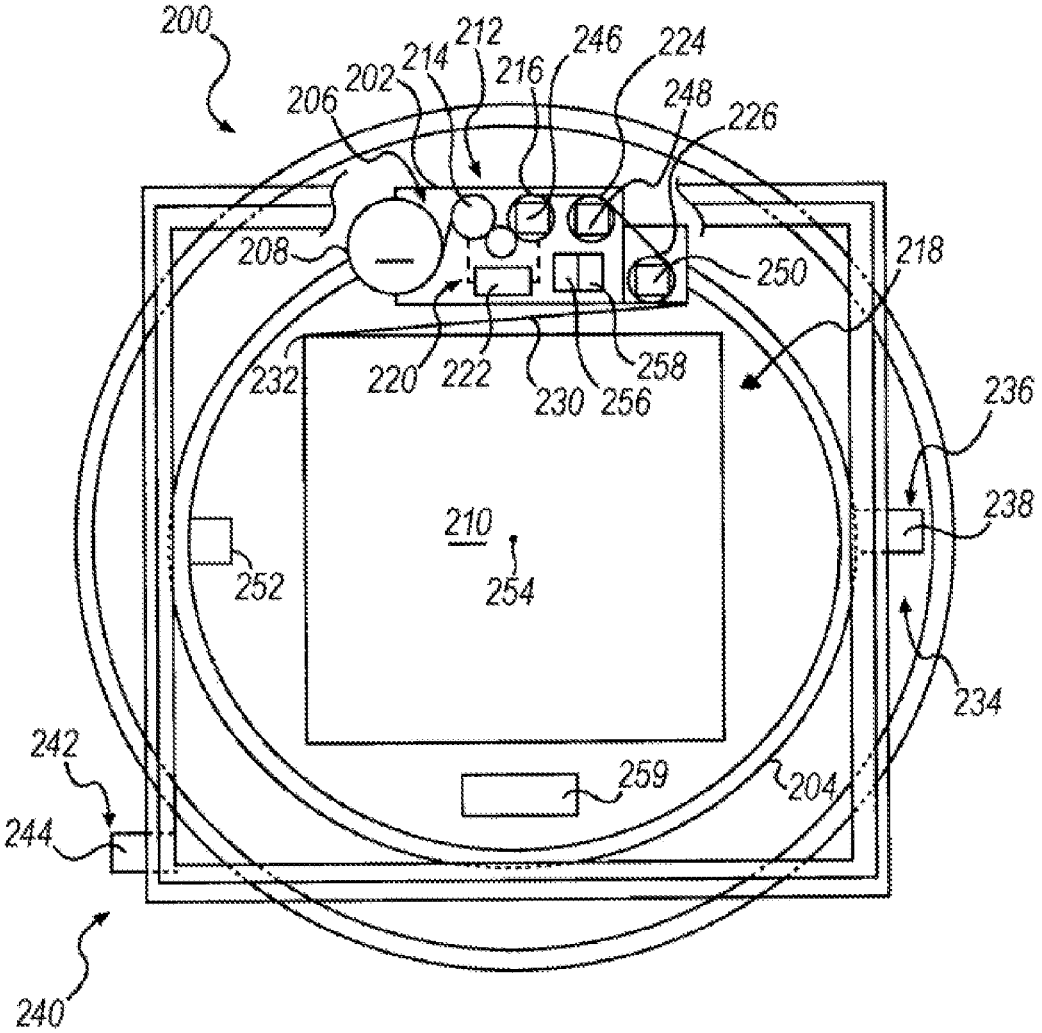
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage or elevator 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254, and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
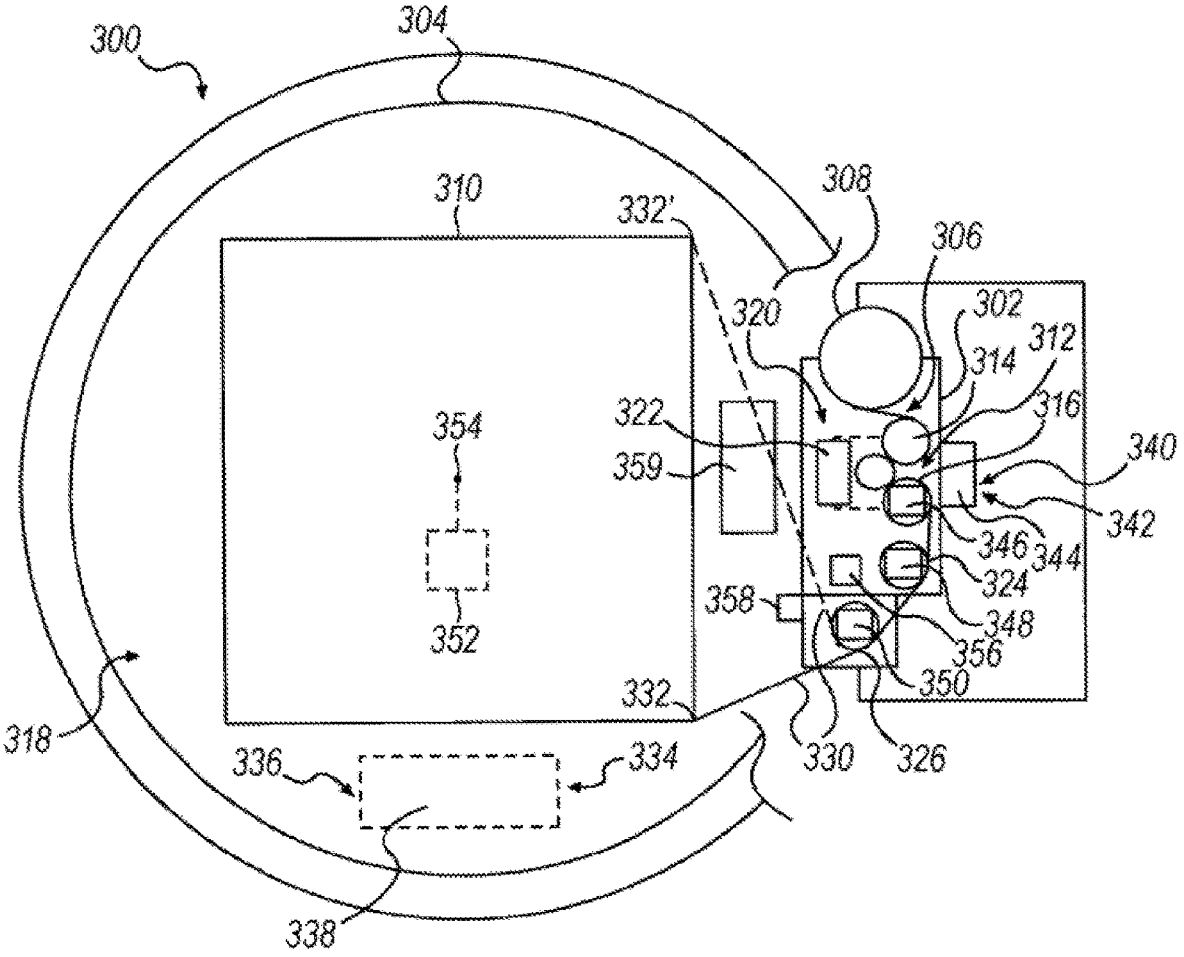
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage or elevator 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a roll carriage or elevator 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a pre-stretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move roll carriage or elevator 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Dispense Rate Control Using Sensed Rate of Dispensed Packaging

Material and Predicted Load Geometry

Figure 5:
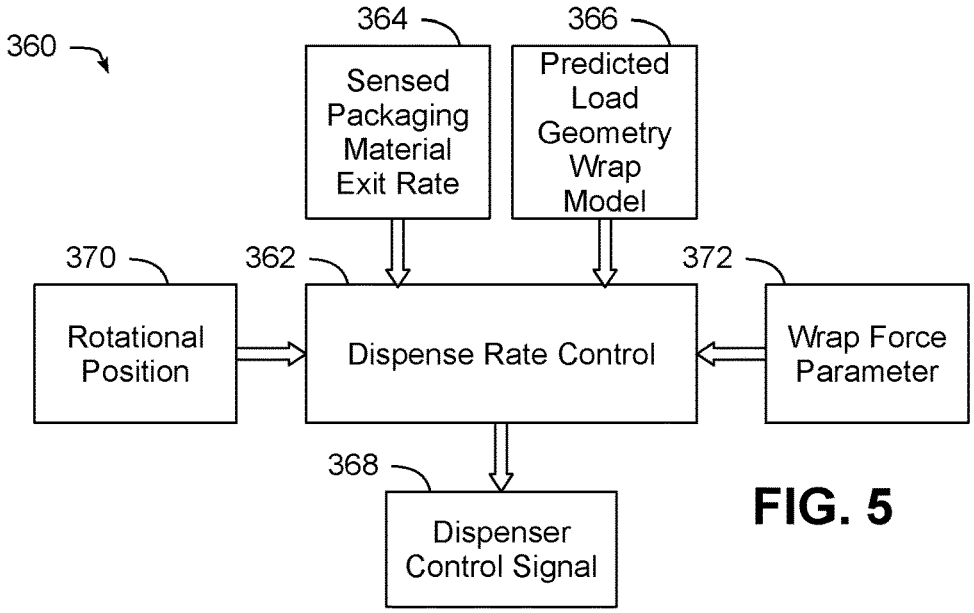
FIG. 5 illustrates a controller suitable for implementing the herein-described techniques in the wrapping apparatus of any of FIGS. 1-4.

In the embodiments discussed hereinafter, a combination of a sensed rate of packaging material exiting the dispenser and a predicted geometric relationship between the packaging material dispenser and the load is used to control a dispense rate of a packaging material dispenser. FIG. 5, for example, illustrates a portion of an example controller 360 for use in a wrapping apparatus, e.g., any of wrapping apparatus 100, 200, 300 discussed above. Controller 360 may include a dispense rate control 362 that receives, as inputs, a sensed packaging material exit rate 364 and a predicted load geometry wrap model 366 and outputs therefrom a dispenser control signal 368, e.g., to control the dispense rate of a packaging material drive system, e.g., any of packaging material drive systems 120, 220, 320. In some embodiments, dispense rate control 362 may also receive as input a rotational position 370, e.g., as generated by an angle sensor such as an encoder that senses the rotational position of the packaging material dispenser relative to the load, or via other manners, e.g., based upon an elapsed time from sensing a home position given a current rate of relative rotation between the packaging material dispenser and the load. In addition, in some embodiments, a wrap force parameter 372, e.g., a payout percentage, may be provided as an input to dispense rate control 362 to control the wrap force applied to the load during wrapping.

Figure 6A:
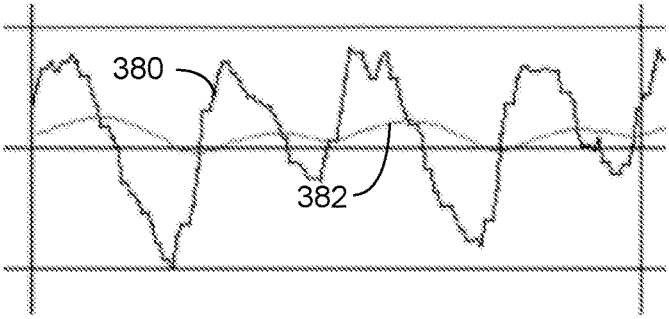
FIG. 6A illustrates unfiltered and filtered rate signals sensed for an example load.

In some embodiments, the sensed packaging material exit rate 364 may be generated, for example, from a rate signal generated from an encoder coupled to a roller of the packaging material dispenser, e.g., sensor 150 coupled to idle roller 126 of FIG. 1. FIG. 6A, for example, illustrates an example raw rate signal 380 output by sensor 150 over a full relative revolution between the packaging material dispenser and the load for a load that is 40"×48" in cross-section (i.e., a girth of 176"), with no offset from the center of rotation. Minimum points on signal 380 generally correspond to corner contacts where a new corner intersects a web of packaging material during relative rotation. In some embodiments, the raw rate signal may be used as an input to dispense rate control 362, while in other embodiments, a filtered rate signal may be used. In some embodiments, a filtered rate signal 382 may be generated from signal 380 using a buffer, e.g., by sampling the output of sensor 150 every X milliseconds and averaging Y samples. In one example embodiment, a rolling average A is maintained, and every 20 milliseconds a new sample N is mixed with the rolling average using Equation (1):

$$A=0.1N+0.9A \tag{1}$$

Other filtering algorithms may be used in other embodiments, as will be appreciated by those of ordinary skill having the benefit of the instant disclosure. For example, various techniques whereby the rate signal is sampled at regular intervals and the samples are filtered may be used. In addition, various filtering techniques, e.g., summing a first percentage of a sampled sense rate with a second percentage of a value calculated during a prior interval (generally where the first and second percentages sum to 100%), may be used. Additional details regarding various manners of generating a rate signal are also disclosed, for example, in U.S. Pat. No. 9,908,648 to Lancaster et al., which is incorporated by reference herein and assigned to the same assignee as the present application.

It will be appreciated that rate signal 382 will generally vary based upon the actual girth (perimeter) of a portion of a load being wrapped, i.e., the larger the cross-sectional perimeter of the load, the greater the baseline of the rate signal. Thus, it will be appreciated that a rate signal consistent with the invention in some aspects may be considered to sense the actual girth of the load at the elevation currently being wrapped. It will also be appreciated that rate signal 382 may be scaled in a number of manners, e.g., based upon the circumference of the roller for which rotation is sensed such that the rate signal is representative of a length of packaging material dispensed per unit of time (e.g., inches per second).

Returning to FIG. 5, predicted load geometry wrap model 366 provides another input to dispense rate control 362. Wrap model 366, in particular, is used to predict the locations of the corners of the load being wrapped and generate therefrom an input utilized by dispense rate control 362 to generate the dispenser control signal 368. In the illustrated embodiment, however, the predicted locations of the corners are not based upon sensing the actual position and dimensions of the load being wrapped. Instead, dimensions of the load, and optionally a horizontal and/or vertical offset of the load, are received as inputs, e.g., via manual operator input or via a wrap profile. The dimensions and/or the offset(s) are then used to determine corner locations for the corners of the load, and a curve is generated therefrom based at least in part on the geometrical relationship between the corners of the load and the packaging material dispenser at different rotational positions, e.g., in the manner disclosed in U.S. Pat. No. 9,932,137 to Lancaster et al., which is incorporated by reference herein and assigned to the same assignee as the present application. It will be appreciated, however, that dimensions, offsets and/or corner locations of a load may also be sensed by sensors in other embodiments. Moreover, while the sensor used herein to sense the rate of packaging material exiting the packaging material dispenser may also be used to generate a wrap model in some embodiments (as disclosed in the Lancaster '137 patent), in the illustrated embodiment the wrap model is generated independent of the sensed rate of packaging material exiting the packaging material dispenser, i.e., the wrap model is generated without using any data generated by the sensor used to sense the rate of packaging material exiting the packaging material dispenser.

The load upon which the wrap model is based may be considered to be the actual load being wrapped, or may be considered to be a standard load type that is representative of the load, rather than the actual load itself. For example, in some embodiments a wrap profile may be established for a standard load type with 40"×48" dimensions and no offset from the center of rotation, and upon selection of this wrap profile, it will be assumed that the actual load being wrapped has generally the same dimensions, such that the wrap profile is suitable for wrapping any loads having the general same dimensions, and irrespective of any actual variations from these dimensions in individual loads. Thus, in applications where loads of similar dimensions are wrapped by the same wrapping apparatus, the same wrap profile may be used to wrap all of the loads, and without having to reselect the same wrap profile prior to wrapping each load. As a consequence, not only the dimensions and the offset of the load, but also the wrap model, may be used to wrap a particular load without sensing dimensions of that particular load or receiving input from an operator of the dimensions or of a particular wrap profile specific to the load. Thus, for example, where a wrapping apparatus is consistently used to wrap 40"×48" loads that are as a regular matter always positioned on the wrapping apparatus with no offset, the dimensions and offset may be entered once (or a suitable wrap profile may be selected once), and all future wrapping operations may proceed for the same-sized loads without having to re-enter the dimensions or offset for each load.

Figure 6B:
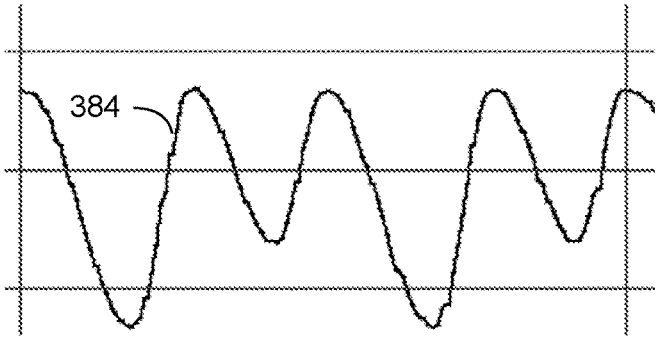
FIG. 6B illustrates a fitted curve generated for a standard type of load having dimensions similar to the example load of FIG. 6A.

While a curve such as generated in the aforementioned Lancaster '137 patent may be used for wrap model 366 in some embodiments, in other embodiments, other wrap models may be used. For example, a fixed or variable rotational data shift as disclosed in Lancaster '137 may be used in some embodiments to effectively advance the wrap model to account for system lag due to electrical and/or mechanical delays in a wrapping apparatus. Moreover, in some embodiments, in addition to or in lieu of applying a rotational data shift, curve fitting may be used to generate a wrap model, e.g., as disclosed in U.S. application Ser. No. 16/531,785, filed on Aug. 5, 2019 by Mitchell et al., which is incorporated by reference herein and assigned to the same assignee as the present application. FIG. 6B, for example, illustrates an example fitted curve 384 calculated in the manner disclosed in the aforementioned Mitchell '785 application for a representative load that is 40"×48" in cross-section (i.e., a girth of 176"), and with no offset from the center of rotation, and with a rotational data shift applied to advance the wrap model to offset expected system lag.

Returning again to FIG. 5, dispense rate control 362 combines the sensed packaging material exit rate and predicted load geometry wrap model to generate a dispenser control signal. In the illustrated embodiment, the combination may be performed by converting (e.g., in block 362) or otherwise generating (e.g., in block 366) the predicted load geometry wrap model as a percentage of girth of the representative load and then using the percentage value calculated or stored for the current rotational position provided by block 370 to scale the sensed packaging material exit rate at the current rotational position. It will be appreciated that in some embodiments, a wrap model may be calculated in advance of a wrapping operation to store a set of percentage values for a plurality of rotational positions, while in other embodiments, such calculations may be performed dynamically, i.e., given a rotational position X, calculate the percentage value for that rotational position based upon dimensions, offset, rotational data shift, curve fitting, and/or wrap force parameter, among others.

In addition, as noted above, the dispense rate control may also receive a wrap force parameter input 372 to vary the wrap force applied during wrapping. The wrap force parameter in some embodiments may be specified as a payout percentage, which refers to the amount in which the dispense rate of the packaging material is scaled relative to a predicted demand. A payout percentage of 100%, for example, corresponds to a dispense rate that substantially meets the predicted demand, whereas a payout percentage of 80% corresponds to a dispense rate that is 80% of the predicted demand, and a payout percentage of 120% corresponds to a dispense rate that is 120% of the predicted demand. In some embodiments, the predicted demand against which the payout percentage may be applied may correspond to a full revolution (i.e., a payout percentage of X % corresponds to dispensing X % of the predicted demand over a full revolution), while in other embodiments the payout percentage may represent a percentage of a predicted demand over only a portion of a revolution. Thus, it will be appreciated that decreasing the payout percentage generally slows the rate at which packaging material exits the packaging material dispenser compared to the relative rotation of the load such that the packaging material is pulled tighter around the load, thereby increasing containment force. In contrast, increasing the payout percentage decreases the wrap force. It will be appreciated also that other metrics may be used as an alternative to payout percentage to reflect the relative amount of wrap force to be applied during wrapping, so the invention is not so limited and a wrap force parameter may therefore be represented in manners other than payout percentage.

As such, in some embodiments, the dispenser control signal may be calculated using Equation (2):

$$DR = WM(RP) \times FR \times PP \tag{2}$$

where DR is the dispense rate, WM( ) is the wrap model, RP is the current rotational position, WM(RP) is the wrap model input for the current rotational position, FR is the filtered rate signal for the current position and PP is the payout percentage.

Figure 6C:
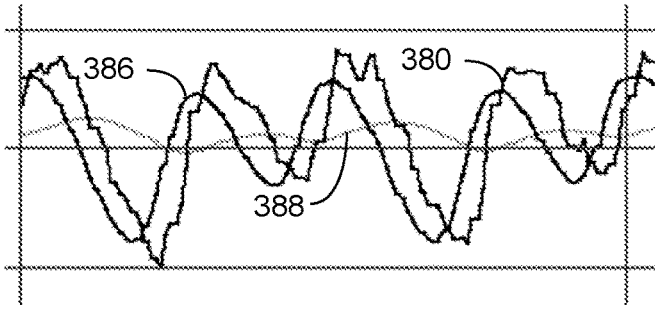
FIG. 6C illustrates a dispenser control signal generated using the filtered rate signal of FIG. 6A and the fitted curve of FIG. 6B.

FIG. 6C, for example, illustrates an example dispenser control signal 386 generated for a representative load of 40"×48", no offset, and 100% payout percentage. Signal 386 is based upon a combination of filtered rate signal 382 illustrated in FIG. 6A and fitted curve 384 of FIG. 6B, and it may be appreciated that signal 386 better matches the unfiltered rate signal 380 than a dispenser control signal 388 that is based solely on a filtered rate signal. It will also be noted that dispenser control signal 386 has been shifted relative to unfiltered rate signal 380 to account for system lag, such that when the dispenser control signal 386 is applied in the wrapping apparatus, the actual dispense rate of the packaging material dispenser will more closely track the demand of the load. It will be appreciated that unfiltered rate signal 380 generally could not be used to control dispense rate because it effectively reflects demand after the fact, in part because when the packaging material contacts a corner, it does not immediately result in an increase in speed of the idle roller.

It will be appreciated that other manners of combining the inputs from blocks 364 and 366 may be used in other embodiments. For example, rather than representing the wrap model in terms of a percentage of girth and scaling the rate input by the wrap model, the rate input may be scaled relative to the girth of the representative load and used to scale the wrap model. In addition, it will be appreciated that a wrap force parameter may be incorporated into the wrap model or into the filtered rate signal in some embodiments. Other variations will be appreciated by those of ordinary skill in the art.

It should be noted that, since filtered rate signal 382 generally scales with the actual girth of a portion of a load being wrapped, the combination of this signal with a wrap model generated based upon dimensions of a representative load effectively scales the wrap model to track the actual girth of the load over the course of a wrapping operation, and thus account for variations in the load that alter the girth relative to the representative load for which the wrap model is created.

It will also be appreciated that dispense rate control as described herein may be performed during an entire wrap cycle, or may be performed only for a portion of a wrap cycle. For example, a constant dispense rate may be used at the beginning and/or end of a wrap cycle in some embodiments.

Figure 7A:
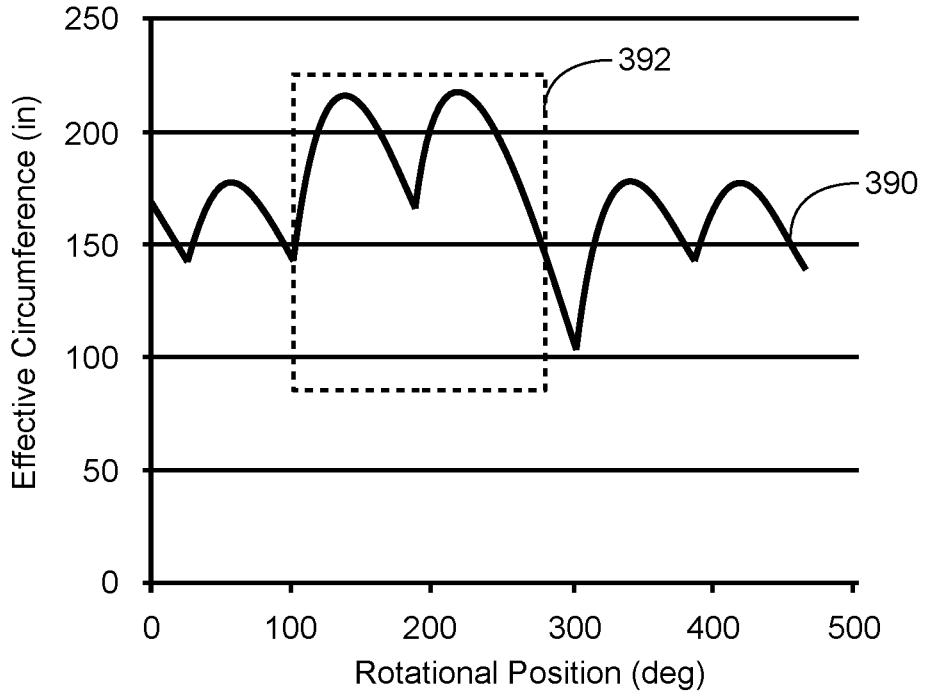
FIG. 7A illustrates a demand curve for an example load.
Figure 7B:
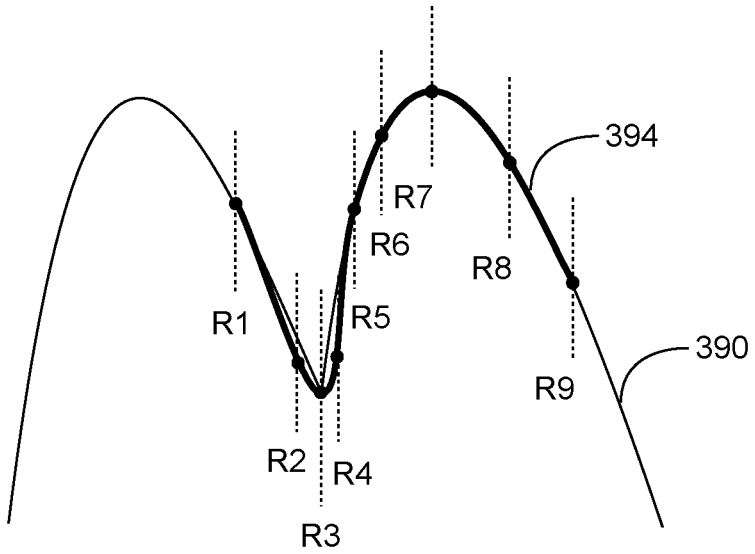
FIG. 7B illustrates a fitted curve superimposed on a portion of the demand curve of FIG. 6A.

Now turning to FIGS. 7A-7B, as noted above a wrap model may be generated in a number of different manners in various embodiments of the invention. In one example embodiment, for instance, it may be desirable to use curve fitting when generating a wrap model for input load dimensions and/or offset(s) for a representative load. With curve fitting, the dispense rate at which to dispense packaging material at a particular rotational position of a packaging material dispenser relative to a load about a center of rotation is determined at least in part using a curve fit between two or more points associated with other rotational positions for which predicted demands have been determined. In some embodiments, for example, for a particular rotational position between two rotational positions that are before and after the particular rotational position, and for which predicted demands have been determined, a dispense rate may be calculated in part using a curve fit between those two rotational positions.

It will be appreciated, for example, that the demand for packaging material at a load during relative rotation between the load and a packaging material dispenser may be predicted or determined in a number of manners, including based upon the dimensions and/or offset of a load within a plane that is orthogonal to an axis of rotation about which relative rotation occurs between a load and a packaging material dispenser, as well as based upon a number of different sensed characteristics. This demand may be used to generate a wrap model that controls the rate at which packaging material is dispensed from the packaging material dispenser to apply a desired wrap force to the load by the packaging material during wrapping.

In various embodiments, curve fitting may be applied to generate a demand curve representing at least a portion of a revolution (e.g., over a range of rotational positions) between a representative load and packaging material dispenser about a center of rotation, and based upon fitting the curve to two or more points corresponding to predicted demands at two or more rotational positions.

As such, the dispense rate for certain rotational positions (referred to for convenience herein as "demand positions") within a revolution will be based upon a predicted demand, while for other rotational positions between those for which the dispense rate is based upon a predicted demand (referred to for convenience herein as "fitted curve positions"), the dispense rate will be based upon a curve fit between two or more demand positions. As will become apparent below, at some fitted curve positions, the demand and/or dispense rate calculated therefrom may still be substantially equal to a predicted demand for that position and/or a dispense rate calculated therefrom simply due to the geometry of the fitted curve; however, at other fitted curve positions the demand and/or dispense rate calculated therefrom will generally depart from the predicted demand for that position and/or a dispense rate calculated therefrom. Thus, for at least a portion of the fitted curve positions within a range of rotational positions, the dispense rates calculated for those fitted curve positions will not equal the dispense rates that would have been calculated for those rotational positions based upon predicted demand.

It will also be appreciated that curve fitting may be applied in a number of different manners in different embodiments. For example, in some embodiments, curve fitting may be applied to generate a curve over a range of rotational positions that may span a portion of a revolution, a full revolution, or even multiple revolutions of a wrap cycle, and the curve may be accessed during a wrap cycle to determine a dispense rate at a particular rotational position during the wrap cycle.

In other embodiments, however, curve fitting may be dynamically performed in connection with determining the dispense rate for a particular rotational position, e.g., by determining a predicted demand at one or more earlier rotational positions and one or more later rotational positions relative to a current rotational positions, and then applying a function (e.g., a sine or other trigonometric function) to dynamically calculate a point on a curve that fits the predicted demands (or dispense rates corresponding thereto) for those earlier and later rotational positions. Put another way, references to "curve fitting" herein should not be considered to imply that a mapping or plotting operation is necessarily performed to explicitly draw a curve or curve segment over multiple rotational positions. Thus, for example, while block 366 of FIG. 5 is described above as generating a wrap model based upon a fitted curve, block 366 in some embodiments may be implemented using a function that is capable of generating a demand, dispense rate, percentage of girth value, or other suitable value for any particular rotational position and given the input dimensions (and optionally, offset) of the load.

Now turning to FIG. 7A, this figure illustrates an example graph 390 of effective circumference over a plurality of rotational positions angles for an example load with a 48 inch length, a 40 inch width, and an offset of 4 inches in length and 0 inches in width from the center of rotation. As will be discussed in greater detail below, effective circumference may be used in some embodiments as a proxy for demand, as effective circumference of a load throughout relative rotation is indicative of an effective consumption rate of the load, which is in turn indicative of the amount of packaging material being "consumed" by the load as the load rotates relative to the packaging dispenser. In particular, effective consumption rate, as used herein, generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load.

Graph 390 may therefore be considered to be a demand curve for some embodiments. A portion of demand curve 390 displayed in box 392 is illustrated in greater detail in FIG. 7B, along with an example curve 394 fit onto a portion of demand curve 390.

Also illustrated in FIG. 7B are a plurality of rotational positions denoted as rotational positions R1-R9. In this example, rotational positions R1, R3, R5, R7 and R9 are demand positions for which predicted demands at those rotational positions have been determined, and from which dispense rates may be calculated based upon those predicted demands. Rotational positions R2, R4, R6 and R8, on the other hand, are fitted curve positions where dispense rates may be calculated based upon values of the curve 394 at those rotational positions. These values may be referred to as demand values, although it will be appreciated that the values are not necessarily representative of the actual demand at those rotational positions. Moreover, as noted above, in some embodiments the fit curve may be scaled to represent a percentage of girth, such that the curve may be used to scale a filtered rate input in order to generate a dispenser control signal for controlling the dispense rate of the packaging material dispenser.

While in some embodiments curve 394 may be generated as a single curve fit to multiple demand positions, in the embodiment illustrated in FIGS. 7A-7B, curve 394 includes multiple segments that are individually fit to groups of demand positions. For example, in one embodiment curve 394 may include a segment fit between demand positions R1 and R3, a segment fit between demand positions R3 and R5, a segment fit between demand positions R5 and R7, and a segment fit between demand positions R7 and R9. In another embodiment, however, curve 394 may include segments fit between more than two demand positions, e.g., one segment fit between demand positions R1, R3 and R5, and another segment fit between demand positions R5, R7 and R9.

As was also noted above, calculated demands for some fitted curve positions may substantially match the predicted demands that would have been calculated based upon the geometry of the load. Thus, for example, the demand values for rotational positions R6 and R8 are illustrated as substantially lying on the demand curve 390. However, at other fitted curve positions, the calculated demands will not equal the predicted demand for those rotational positions based upon predicted demand, and thus, the demand values for rotational positions R2 and R4 are illustrated as lying offset from the demand curve 390.

Figure 8:
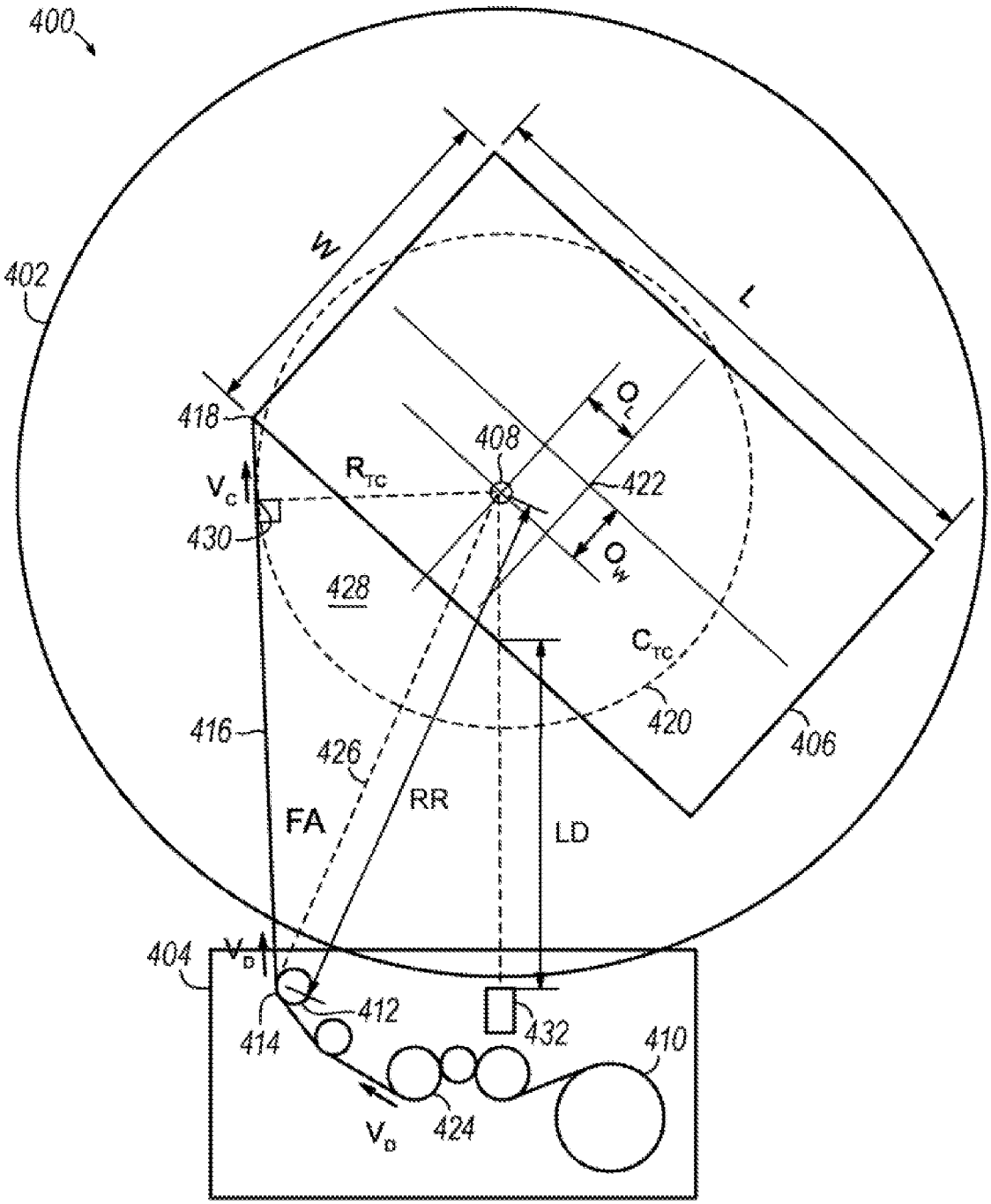
FIG. 8 is a top view of a packaging material dispenser and a load, illustrating a tangent circle defined for the load throughout relative rotation between the packaging material dispenser and the load.

Now turning to FIG. 8, as noted above, demand may be predicted in a number of different manners in different embodiments. In some embodiments, for example, demand may be predicted based upon a geometric relationship between a packaging material dispenser and corners of the load, e.g., based upon effective circumference as disclosed in the aforementioned Lancaster '137 patent.

FIG. 8, for example, functionally illustrates a wrapping apparatus 400 in which a load support 402 and packaging material dispenser 404 are adapted for relative rotation with one another to rotate a load 406 about a center of rotation 408 and thereby dispense a packaging material 410 for wrapping around the load. In this illustration, the relative rotation is in a clockwise direction relative to the load (i.e., the load rotates clockwise relative to the packaging material dispenser, while the packaging material dispenser may be considered to rotate in a counter-clockwise direction around the load). As mentioned above, the effective circumference of a load throughout relative rotation is indicative of an effective consumption rate of the load, which generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load, and thus, in FIG. 8, an idle roller 412 defines an exit point 414 for packaging material dispenser 404, such that a portion of web 416 of packaging material 410 extends between this exit point 414 and an engagement point 418 at which the packaging material 410 engages load 406. In this arrangement, a tangent circle 420 is tangent to portion 416 and is centered at center of rotation 408.

The tangent circle has a circumference $C_{TC}$, which may be considered to be the "effective circumference" of the load. Likewise, other dimensions of the tangent circle, e.g., the radius $R_{TC}$ and diameter $D_{TC}$, may be respectively referred to as the "effective radius" and "effective diameter" of the load.

It has been found that for a load having a non-circular cross-section, as the load rotates relative to the dispenser about center of rotation 408, the size (i.e., the circumference, radius and diameter) of tangent circle 420 dynamically varies, and that the size of tangent circle 420 throughout the rotation effectively models, at any given angular or rotational position of the load relative to the dispenser, a rate at which packaging material should be dispensed in order to match the consumption rate of the load, i.e., where the dispense rate in terms of linear velocity (represented by arrow $V_D$) is substantially equal to the tangential velocity of the tangent circle (represented by arrow $V_C$). Thus, in situations where a payout percentage of 100% is desired, the desired dispense rate of the packaging material may be set to substantially track the dynamically changing tangential velocity of the tangent circle, and thus the predicted demand.

Of note, the tangent circle is dependent not only on the dimensions of the load (i.e., the length L and width W), but also the offset of the geometric center 422 of the load from the center of rotation 408, illustrated in FIG. 7 as $O_L$ and $O_W$. Given that in many applications, a load will not be perfectly centered when it is placed or conveyed onto the load support, the dimensions of the load, by themselves, typically do not present a complete picture of the effective consumption rate of the load. Nonetheless, as will become more apparent below, the calculation of the dimensions of the tangent circle, and thus the effective consumption rate, may be determined without determining the actual dimensions and/or offset of the load in some embodiments.

It has been found that this tangent circle, when coupled with the web of packaging material and the drive roller (e.g., drive roller 424), functions in much the same manner as a belt drive system, with tangent circle 420 functioning as the driver pulley, dispenser drive roller 424 functioning as the follower pulley, and web 416 of packaging material functioning as the belt. For example, let $N_d$ be the rotational velocity of a driver pulley in RPM, $N_f$ be the rotational velocity of a follower pulley in RPM, $R_d$ be the radius of the driver pulley and $R_f$ be the radius of the follower pulley. Consider the length of belt that passes over each of the driver pulley and the follower pulley in one minute, which is equal to the circumference of the respective pulley (diameter *π, or radius *2π) multiplied by the rotational velocity:

$$L_d=2\pi*R_d*N_d \tag{3}$$

$$L_f=2\pi*R_f*N_f \tag{4}$$

where $L_d$ is the length of belt that passes over the driver pulley in one minute, and $L_f$ is the length of belt that passes over the follower pulley in one minute.

In this theoretical system, the point at which neither pulley applied a tensile or compressive force to the belt (which generally corresponds to a payout percentage of 100%) would be achieved when the tangential velocities, i.e., the linear velocities at the surfaces or rims of the pulleys, were equal. Put another way, when the length of belt that passes over each pulley over the same time period is equal, i.e., $L_d=L_f$. Therefore:

$$2\pi*R_d*N_d=2\pi*R_f*N_f \tag{5}$$

Consequently, the velocity ratio VR of the rotational velocities of the driver and follower pulleys is:

$$VR=\frac{N_d}{N_f}=\frac{R_f}{R_d} \tag{6}$$

Alternatively, the velocity ratio may be expressed in terms of the ratio of diameters or of circumferences:

$$VR = \frac{N_d}{N_f} = \frac{D_f}{D_d} \tag{7}$$

$$VR = \frac{N_d}{N_f} = \frac{C_f}{C_d} \tag{8}$$

where $D_f$, $D_d$ are the respective diameters of the follower and driver pulleys, and $C_f$, $C_d$ are the respective circumferences of the follower and driver pulleys.

Returning to equations (3) and (4) above, the values $L_d$ and $L_f$ represent the length of belt that passes the driver and follower pulleys in one minute. Thus, when the tangent circle for the load is considered a driver pulley, the effective consumption rate (ECR) may be considered to be equal to the length of packaging material that passes the tangent circle in a fixed amount of time, e.g., per minute:

$$\text{ECR}=C_{TC}*N_{TC}=2\pi*R_{TC}*N_{TC} \tag{9}$$

where $C_{TC}$ is the circumference of the tangent circle, $N_{TC}$ is the rotational velocity of the tangent circle (e.g., in revolutions per minute (RPM)), and $R_{TC}$ is the radius of the tangent circle.

Therefore, given a known rotational velocity for the load, a known circumference of the tangent circle at a given instant and a known circumference for the drive roller, the rotational velocity of the drive roller necessary to provide a dispense rate that substantially matches the effective consumption rate is:

$$N_{DR} = \frac{C_{TC}}{C_{DR}} * N_L \tag{10}$$

where $N_{DR}$ is the rotational rate of the drive roller, $C_{TC}$ is the circumference of the tangent circle and the effective circumference of the load, CDR is the circumference of the drive roller and NL is the rotational rate of the load relative to the dispenser.

The manner in which the dimensions (i.e., circumference, diameter and/or radius) of the tangent circle may be calculated or otherwise determined in order to model predicted demand may also vary in different embodiments, e.g., as is disclosed in the Lancaster '137 patent reference above. For example, input load dimensions (and optionally offset) may be used to determine various dimensions of the load, such as corner contact angles, corner contact radials, and/or corner radials, from which may be generated a film angle that may be used to determine an effective radius, diameter or circumference of the tangent circle for any given rotational position.

Film angle, in this regard, generally refers to the angle FA at exit point 414 between portion 416 of packaging material 410 (to which tangent circle 420 is tangent) and a radial or radius 426 extending from center of rotation 408 to exit point 414. It will be appreciated that the film angle FA may be used to determine the effective radius based upon the known distance from the exit point and the center of rotation and the film angle, given that the known distance forms the hypotenuse of a right triangle where the effective radius is the side opposite the film angle, as illustrated in FIG. 8.

Figure 9:
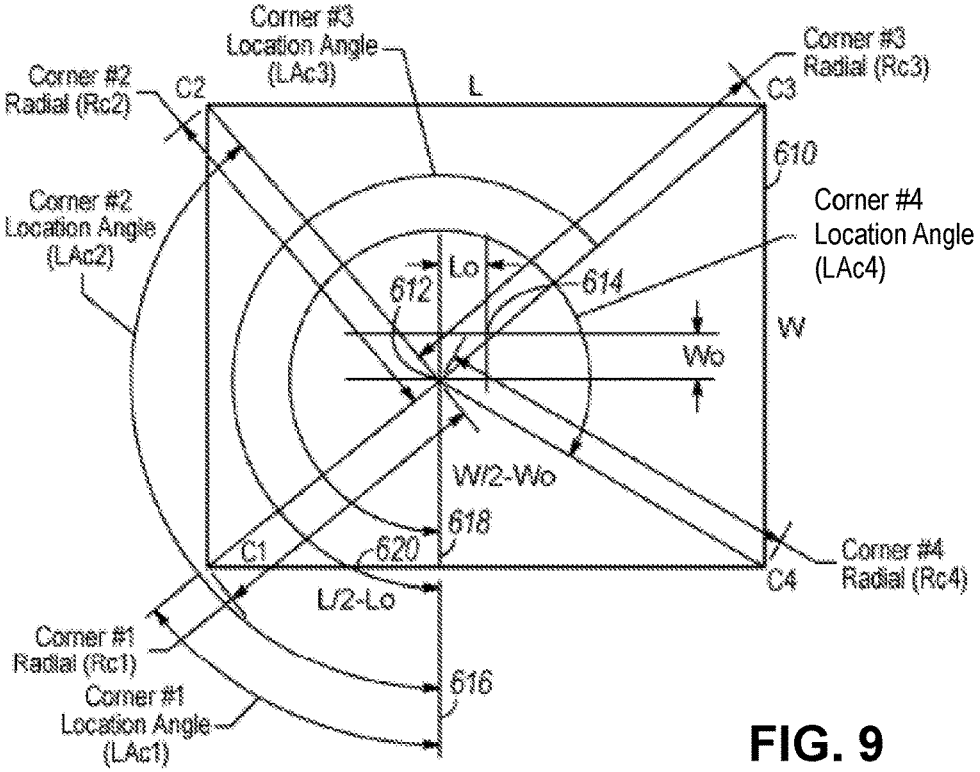
FIG. 9 illustrates various dimensions and angles defined on an example load.

For example, as shown in FIG. 9, an example load 610 of length L and width W, and having four corners denoted C1, C2, C3 and C4, may be considered to have four corner radials Rc1, Rc2, Rc3 and Rc4 extending from a center of rotation 612 to each respective corner. The load has a geometric center 614 that is offset along the length and width as represented by Lo and Wo.

The location of each corner may be defined, for example, using polar coordinates for each of the corner radials, defining both a length (RcX, where X=1, 2, 3, or 4) and an angle (referred to as a corner location angle, LAcX) relative to a base angular position, such as defined at 616. Alternatively, Cartesian coordinates may be used. The length and the width of the load may be determined using the corner radial locations, for example, by applying the law of cosines to the triangles formed by the corner radials and the outer dimensions of the load. Furthermore, to determine the corner location angle for the corner radials, the orthogonal distances from the center of rotation to the sides of the rectangle may be used to define a right triangle with the corner radial as the hypotenuse. As shown in FIG. 9, for example, for corner radial Rc1, a right triangle is defined between the corner radial and line segments 618, 620, and it will be appreciated that the corner location angle LAc1 may be determined in a number of manners, e.g., by taking the arcsine of the ratio of segment 620 and the corner radial Rc1. Then, based on the locations of the corner radials, the film angle at any rotational position of the load may be determined, e.g., as described in the aforementioned Lancaster '137 patent.

Figure 10:
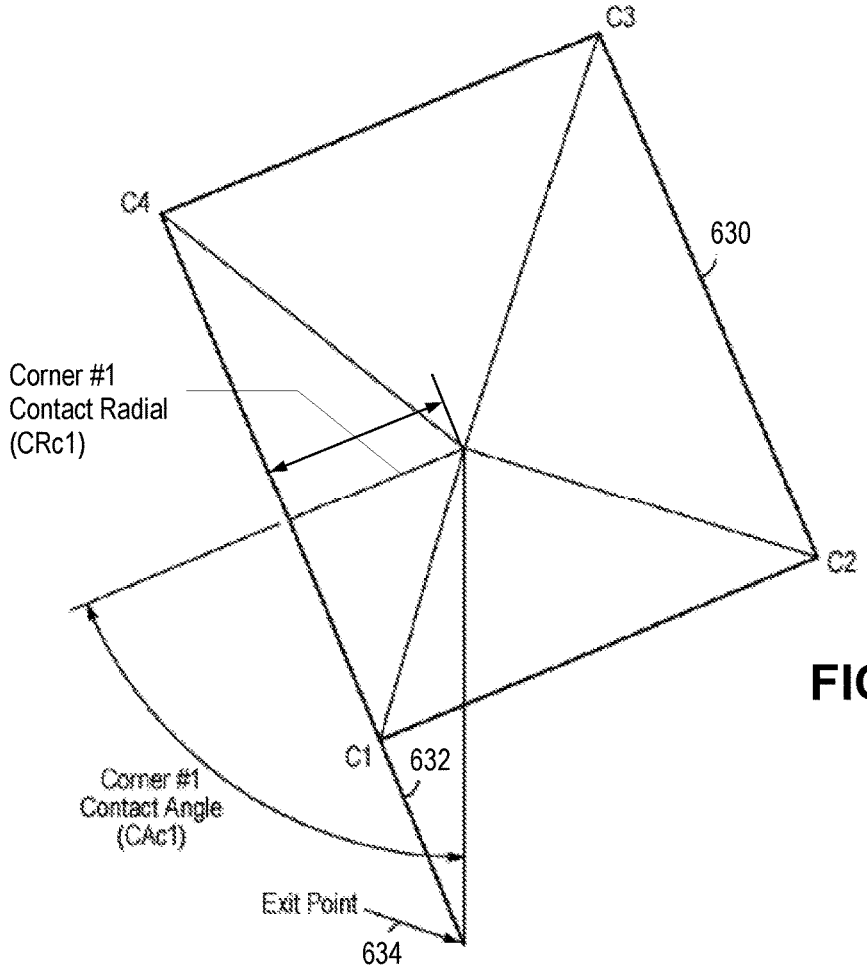
FIG. 10 illustrates various dimensions and angles defined on another example load and used to determine a contact angle for a corner.

In addition, corner contact radials may also be used to determine predicted demand. FIG. 10, for example, illustrates an example load 630 including corners C1-C4 with a web 632 of packaging material extending between load 630 and an exit point 634. Of note, the figure illustrates the moment in which contact occurs between web 632 with corner C1, after having previously been extending between corner C4 to exit point 634. A corner contact radial CRc1 extends from the center of rotation to the surface of web 632, and substantially perpendicular thereto. The corner contact angle for the corner contact radial CRc1 is illustrated at CAc1, and represents a position relative to a home position where web 632 first contacts corner C1.

In addition, in some embodiments of the invention, a wrap speed model and wrap speed control utilizing such a wrap speed model may be based at least in part on rotation angles associated with one or more corners of a load when determining predicted demand. In this regard, a corner rotation angle may be considered to include an angle or rotational position about a center of rotation that is relative to or otherwise associated with a particular corner of a load. In some embodiments, for example, a corner rotation angle may be based on a corner location angle for a corner, and represent the angular position of a corner radial relative to a particular base or home position (e.g., for corner C1 of load 610 of FIG. 9, the corner radial is Rc1 and the corner location angle is LAc1). Alternatively, a corner rotation angle may be based on a corner contact angle for a corner contact radial, representing an angle at which packaging material first comes into contact with a corner during relative rotation between the load and a packaging material dispenser (e.g., for corner C1 of load 630 of FIG. 10, the corner contact radial is CRc1 and the corner contact angle is CAc1). Given that these and other angles are geometrically related to one another based on the geometry of the load, it will be appreciated that a corner rotation angle consistent with the invention is not limited to only a corner location angle or a corner contact angle, and that other angles relative to or otherwise associated with a corner may be used in the alternative.

Corner rotation angles may be used in connection with wrap speed control in a number of manners consistent with the invention, in addition to use in connection with determining predicted demand. For example, in some embodiments, corner rotation angles may be used to determine to what corner the packaging material is currently engaging, and thus, what corner is effectively "driving" the effective consumption rate or predicted demand of the load. In this regard, in some embodiments, multiple corners may be tracked to enable a determination to be made as to when to switch from a current corner to a next corner when determining predicted demand and/or controlling dispense rate. In other embodiments, corner rotation angles may be used to anticipate corner contacts and perform controlled interventions, and in still other embodiments, corner rotation angles may be used in the performance of rotational data shifts. Corner rotation angles may also be used in connection with curve fitting, as will become more apparent below.

In some embodiments of the invention, for example, it may be desirable to determine and/or predict or anticipate a rotation angle such as a contact angle of each corner of a load during the relative rotation. In some embodiments, a contact angle, representing the rotational position of the load when the packaging material first contacts a particular corner, may be determined for each corner.

Returning to FIG. 8, when a calculated film angle is used to determine predicted demand, effective circumference may be determined based upon the right triangle 428 defined by center of rotation 408, exit point 414, and a tangent point 430 where web 416 of packaging material 410 intersects with tangent circle 420. Given that an effective radius $R_{TC}$ extending between center of rotation 408 and point 430 forms a right angle with web 416, and further given that the length of the rotation radial (RR), i.e., the radius 426 from center of rotation 408 to exit point 414, is known, the effective radius $R_{TC}$ may be calculated using the film angle (FA) and length RR as follows:

$$R_{TC}=RR*\sin(FA) \tag{11}$$

Furthermore, the effective circumference $C_{TC}$ may be calculated from the effective radius as follows:

$$C_{TC}=2\pi*R_{TC}=2\pi*RR*\sin(FA) \tag{12}$$

In some embodiments, exit point 414 is defined at a fixed point proximate idle roller 412, e.g., proximate a tangent point at which web 416 disengages from idle roller 412 when web 416 is about half-way between the maximum and minimum film angles through which the web passes for a particular load, or alternatively, for all expected loads that may be wrapped by wrapping apparatus 400. Alternatively, exit point 414 may be defined at practically any other point along the surface of idle roller 412, or even at the center of rotation thereof. In other embodiments, however, it may be desirable to dynamically determine the exit point based on the angle at which web 416 exits the dispenser. Other dynamically or statically-defined exit points proximate the packaging material dispenser may be used in other embodiments consistent with the invention.

Figure 11:
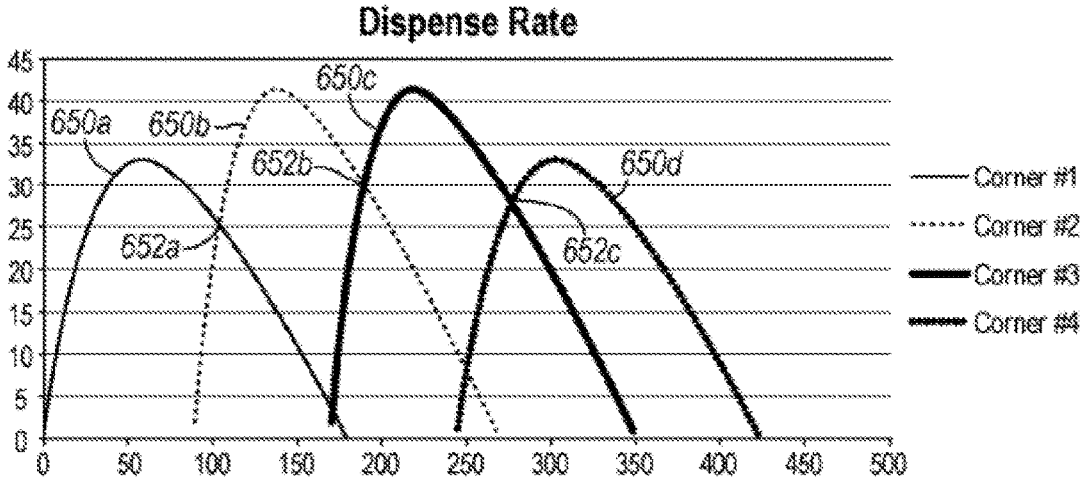
FIG. 11 illustrates a graph of dispense rates for four corners of a load.

Now turning to FIG. 11, this figure illustrates a graph of the ideal dispense rates for corner profiles 650*a*, 650*b*, 650*c* and 650*d* for the four corners of an example load. It should be noted that the intersections of these profiles, at 652*a*, 652*b* and 652*c*, represent the contact angles when the packaging material, which is being driven by one corner, contacts the next corner such that the next corner begins to drive the desired dispense rate of the packaging material. Comparing FIG. 11 to FIG. 7A it may be seen that the effective circumference generally tracks these profiles and contact angles, and as such, in some embodiments, the contact angles may be sensed using a number of the aforementioned sensors.

For example, each of a film angle sensor and a load distance sensor will reach a local minimum proximate each contact angle. Thus, a wrap speed control may be configured to switch from one corner to a next corner based on the anticipated rotational position of each corner as sensed in either of these manners. As another example, an effective radius or effective circumference may be calculated based upon a current corner and a next corner, such that the contact angle is determined at the angle where the effective radius/effective circumference of the next corner becomes larger than that of the current corner. Alternatively, the contact angles may be calculated based on the dimensions of the load, in the general manner described above.

The contact angle of each corner may therefore be determined and used to select which corner is currently "driving" the dispensing process, based upon the known angular relationship of the load to the packaging material dispenser at any given time. A predicted load geometry wrap model (e.g., wrap model 366 of FIG. 5) may therefore be based in some embodiments at least in part on a determination of which corner is actively driving the dispensing process such that the geometrical relationship between the active corner and the packaging material dispenser may be used to determine predicted demand for a particular rotational position during wrapping.

It will be appreciated that other trigonometric formulas and rules may be utilized to derive various dimensions and angles utilized herein to determine effective consumption rate and/or predicted demand without departing from the spirit and scope of the invention.

Figure 13:
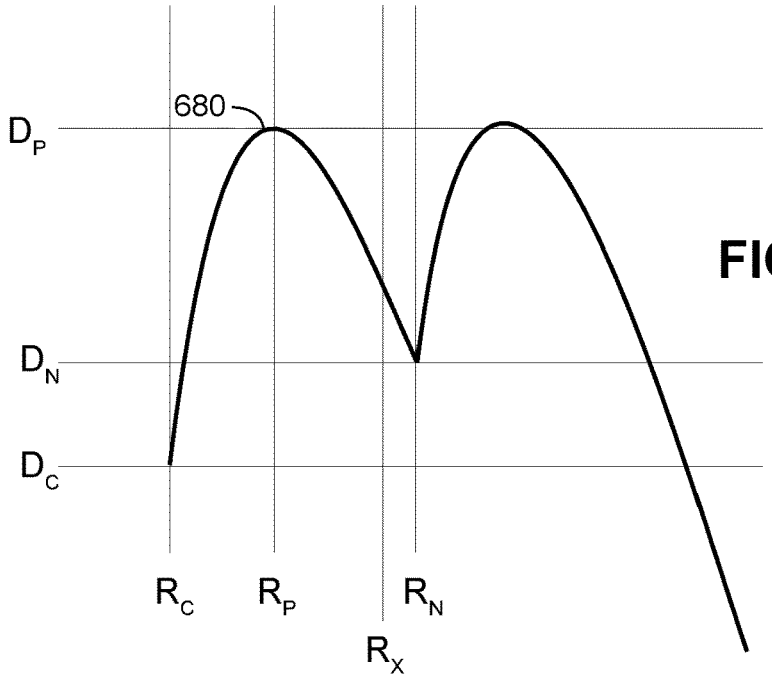
FIG. 13 illustrates various points on a portion of the demand curve of FIG. 7A.
Figure 12:
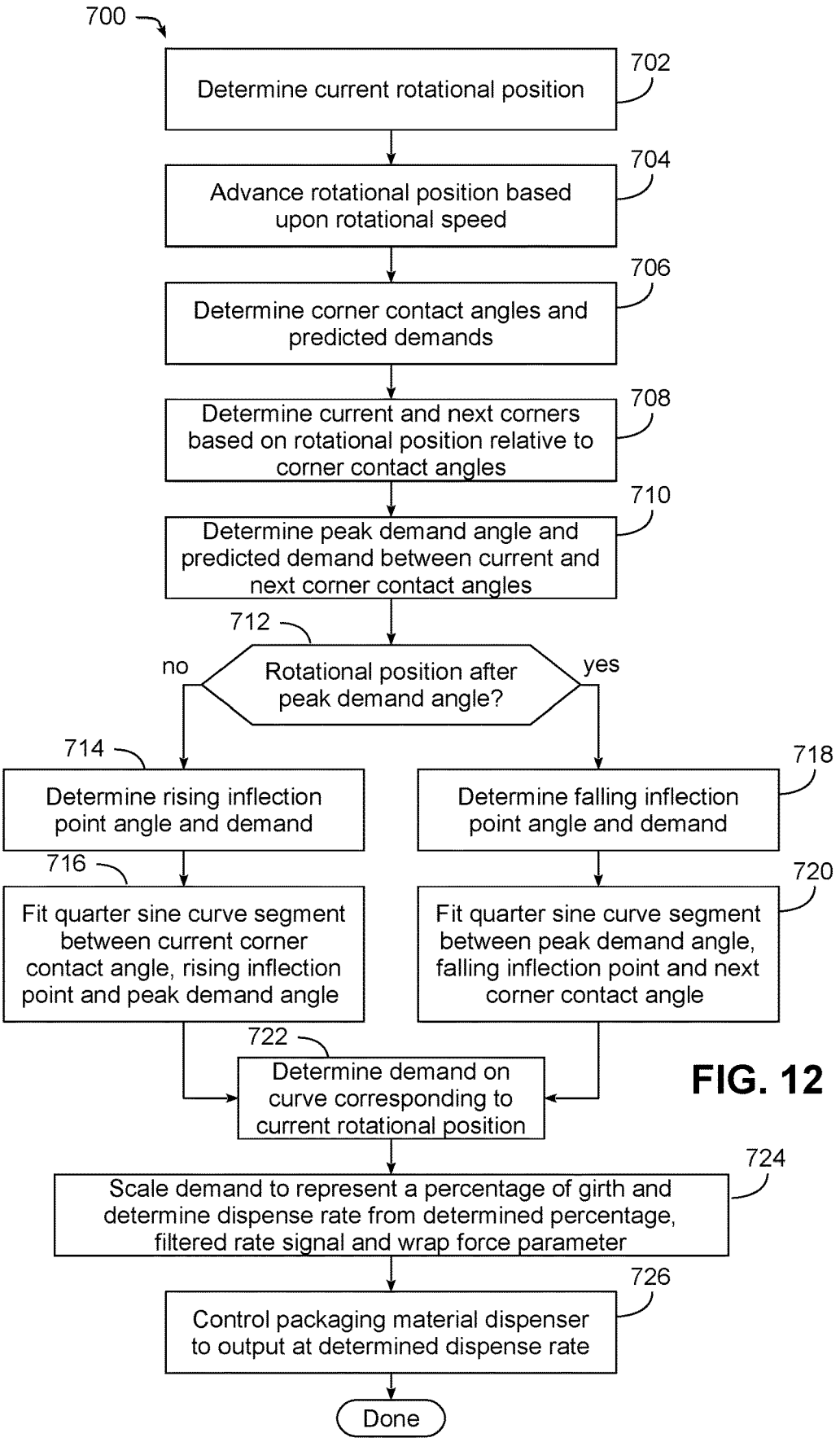
FIG. 12 is a flowchart illustrating an example sequence of operations for determining and controlling a dispense rate of a packaging material dispenser consistent with the invention.

Now turning to FIG. 12, and with additional reference to FIGS. 13-17, an example sequence of operations 700 is illustrated for controlling a packaging material dispenser to dispense at a dispense rate calculated based upon the herein-described techniques. In addition, to facilitate a further understanding of the herein-described techniques, FIG. 13 illustrates at 680 a portion of demand curve 390 illustrated in FIGS. 7A-7B, with a horizontal axis representing rotational position and a vertical axis representing predicted demand.

For the purposes of this example implementation, the determination of a demand for a rotational position $R_X$ is described, and a number of values used in the determination of this demand are illustrated in FIG. 13. In particular, for the rotational position $R_X$, the predicted demands for both a current corner (i.e., the corner between which the web of packaging material is currently engaging) and/or the next corner (i.e., the next corner that will engage the web of packaging material after further rotation between the load and the packaging material dispenser, as well as the predicted demand for a peak demand angle between the current and next corners, may be used. As noted above, the corner contact angles are local minimums in demand, while the peak demand angle is a local maximum in demand.

Figure 14:
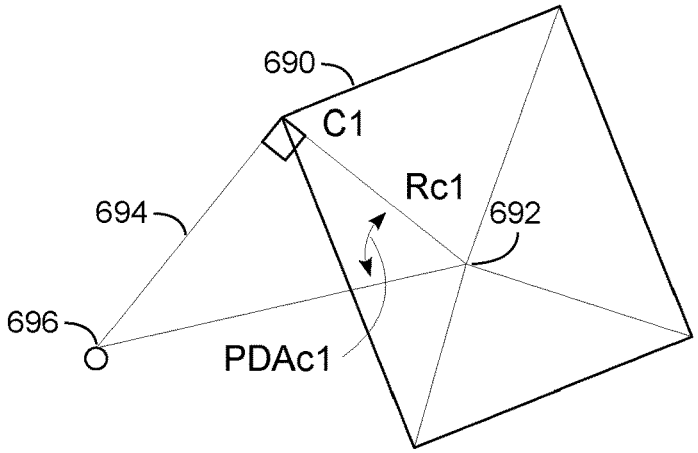
FIG. 14 illustrates various dimensions and angles defined on an example load and used to determine a peak demand angle.

Further, in the example implementation, the peak demand angle is located at the rotational position where the corner radial for the current corner forms about a 90 degree angle with the web of packaging material. As shown in FIG. 14, for example, for a corner C1 of a load 690 that rotates about a center of rotation 692, the peak demand angle (e.g., PDAc1 when rotational position is defined relative to a line extending between center of rotation 692 and exit point 696) occurs when the corner radial for that corner, Rc1, forms a 90 degree angle with web 694 extending between corner C1 and exit point 696. Moreover, it will be appreciated that the effective circumference at the peak demand angle will be based upon an effective radius that is equal to the length of the corner radial Rc1 at this point. Thus, in this example the peak demand at the peak demand angle is $2\pi$*Rc1.

Thus, for the current corner, the corner contact angle is denoted in FIG. 13 as $R_C$ and the predicted demand at that corner contact angle is denoted as $D_C$. Likewise, for the next corner, the corner contact angle is denoted as $R_N$ and the predicted demand at that corner contact angle is denoted as $D_N$. The peak demand angle is denoted as $R_P$ and the predicted demand at that angle is denoted as $D_P$.

Now returning to FIG. 12, sequence 700 is used to dynamically calculate and control a dispense rate for a current rotational position of a load relative to a packaging material dispenser. Sequence 700 may be executed, for example, within a controller of a stretch wrapping machine, e.g., controller 170 of FIG. 2, although in other embodiments some or all of the operations performed in sequence 700 may be performed remote from a stretch wrapping machine, e.g., within a server, cloud-based service, a mobile device, etc.

Each iteration of sequence 700 specifically determines a dispense rate for a particular rotational position, which is determined in block 702. The rotational position may be determined, for example, based upon a signal provided by an angle sensor (e.g., angle sensor 152), and represents a current rotational position of the load relative to the packaging material dispenser, or based upon an elapsed time from encountering the home position (detected using a home position sensor) and a current rate of relative rotation (e.g., in RPMs).

Next, in block 704, in some embodiments a rotational data shift may be performed to offset system lag. In particular, as mentioned above, it may be desirable in some embodiments to account for system lags through the use of a rotational shift of the data utilized by a wrap speed model. From an electronic standpoint, delays due to the response times of sensors and drive motors, communication delays, and computational delays in a controller will necessarily introduce some amount of lag. Moreover, from a physical or mechanical standpoint, sensors may have delays in determining a sensed value and drive motors, such as the motor(s) used to drive a packaging dispenser, as well as the other rotating components in the packaging material, typically have rotational inertia to overcome whenever the dispense rate is changed. Furthermore, packaging material typically has some degree of elasticity even after prestretching, so some lag will exist before changes in dispense rate propagate through the web of packaging material. In addition, mechanical sources of fluctuation, such as film slippage on idle rollers, out of round rollers and bearings, imperfect mechanical linkages, flywheel effects of downstream non-driven rollers, may also exist. These delays can therefore introduce a system lag, such that a desired dispense rate at a particular rotational position of the load, as calculated by a wrap speed model, will not occur at the load until after some duration of time or further angular rotation.

To address this issue, a rotational shift may be applied to the sensed data used by the wrap speed model or to the calculated dimensions or position of the load, which in either case has the net effect of advancing the wrap speed model to an earlier point in time or rotational position such that the actual dispense rate at the load will more closely line up with that calculated by the wrap speed model, thereby aligning the phase of the profile of the actual dispense rate with that of the desired dispense rate calculated by the wrap speed model.

In some embodiments, the system lag from which the rotational shift may be calculated may be a fixed value determined empirically for a particular wrapping apparatus. In other embodiments, the system lag may have both fixed and variable components, and as such, may be derived based upon one or more operating conditions of the wrapping apparatus. For example, a controller may have a fairly repeatable electronic delay associated with computational and communication costs, which may be assumed in many instances to be a fixed delay. In contrast, the rotational inertia of packaging material dispenser components, different packaging material thicknesses and compositions, and the wrapping speed (e.g., in terms of revolutions per minute of the load) may contribute variable delays depending upon the current operating condition of a wrapping apparatus. As such, in some embodiments, the system lag may be empirically determined or may be calculated as a function of one or more operating characteristics. In the embodiments discussed hereinafter, for example, the system lag may be calculated as a function of the current rotational speed (i.e., rate of relative rotation between the load and the packaging material dispenser).

Rotational shifts may also be applied in other manners consistent with the invention. For example, rather than performing a rotational shift by advancing the rotational position as is performed in block 704, the demand curve may be shifted. In other embodiments, no rotational shift may be performed, and block 704 may be omitted.

Next, in block 706 corner contact angles may be determined for one or more of the corners of the load based upon the geometry of the load, along with predicted demands at each of those corner contact angles. The corner contact angles and predicted demands therefor may be determined in any of the various manners discussed above, e.g., based upon sensed or input load dimensions and offset, or in other manners of sensing predicted demand as discussed above. Corner contact angles may be determined based upon local minimums in sensed predicted demand in some embodiments, and may be based in some embodiments on sensor data collected during earlier relative revolutions. In addition, corner contact angles may be determined in block 706 in some embodiments for only a subset of the corners of the load (e.g., a current and/or next corner of the load), or for all corners, and in some embodiments, the corner contact angles and/or the predicted demands therefor may be calculated and stored, whereby the determinations in block 706 may include the retrieval of previously calculated values (e.g., as may be determined prior to commencing a wrapping operation, during an earlier relative revolution, etc.).

Next, in block 708, current and next corners are determined, e.g., by comparing the current rotational position to the corner contact angles of each corner to determine what corner is currently engaged by the packaging material and what corner will be the next corner to be engaged. Then, in block 710, a peak demand angle and predicted demand therefor is determined for the point of peak demand between the current and next corners. In some embodiments, these values may be determined based upon load geometry and in the manner discussed above. In other embodiments, these values may be determined via sensing, e.g., by sensing a local maximum in demand during a prior relative revolution. In addition, as with the corner contact angles and predicted demands therefor, these values may be determined at various times, e.g., prior to commencing wrapping, during an earlier relative revolution, during the current relative revolution, etc.

Block 712 next determines whether the current rotational position is before or after the peak demand angle, thereby indicating whether the demand is increasing or decreasing. In the illustrated embodiment, a quarter sine curve, i.e., a curve representative of one fourth of the period of a sinusoidal function (e.g., 90 degrees of a 360 degree sinusoidal function), is fit between the peak demand angle and the corner contact angle for either the current corner or the next corner, with block 712 effectively selecting between the corner contact angle for the current corner and the corner contact angle for the next corner with which to fit the curve. When prior to the peak demand angle, the corner contact angle for the current corner is used as one endpoint and the peak demand angle is used as another endpoint, with a third, intermediate point referred to herein as a rising inflection point additionally used in the curve fitting operation. Conversely, when after the peak demand angle, the corner contact angle for the peak demand angle is used as one endpoint and the corner contact angle for the next corner is used as another endpoint, with a third, intermediate point referred to herein as a falling inflection point additionally used in the curve fitting operation. Thus, in the illustrated embodiment, each quarter sine curve generally represents a portion of a sinusoidal function between a peak (a point of maximum amplitude) and a trough (a point of minimum amplitude), or conversely, between a trough and a peak, although the invention is not so limited.

Figure 15:
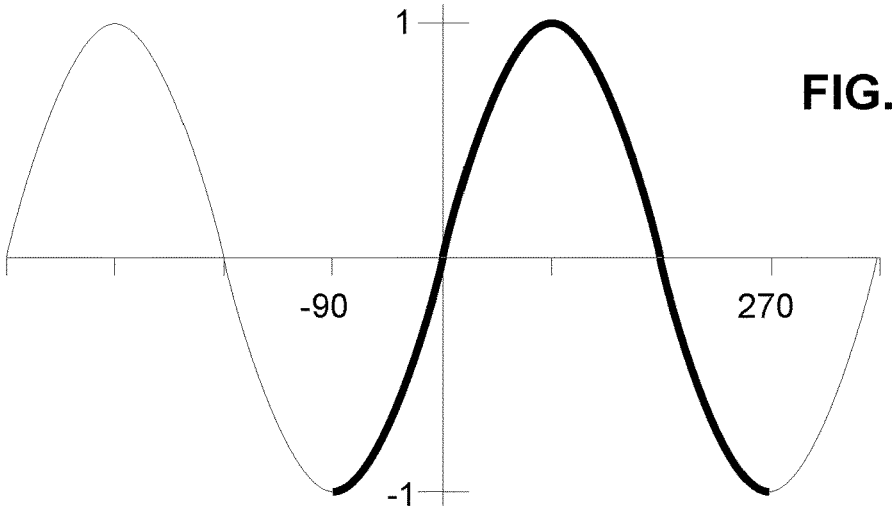
FIG. 15 illustrates an example sine curve.

The rising and falling inflection points represent points in the respective quarter sine curve where the range of change in demand shifts between increasing and decreasing. In the illustrated embodiment, these points are determined in the general manner illustrated in FIGS. 15-17. In particular, FIG. 15 illustrates a generic sine curve, with the portion between −90 degrees and 270 degrees illustrated in bold. It will be appreciated that the bolded portion has a similar profile to the segment of a predicted demand curve between two corners (e.g., the segment between the current and next corner contact angles illustrated in FIG. 13), with the local minimums at −90 and 270 degrees corresponding generally to the contact angles for the current and next corners, and the local maximum at 90 degrees corresponding generally to the peak demand angle between the current and next corners.

In order to fit a curve onto this segment of a demand curve, the rising and falling inflection points may be generated as being half way between the respective corner contact angles and the peak demand angle, with demand values that are the averages of the demand values associated with the respective corner contact angles and peak demand angle.

Figure 16:
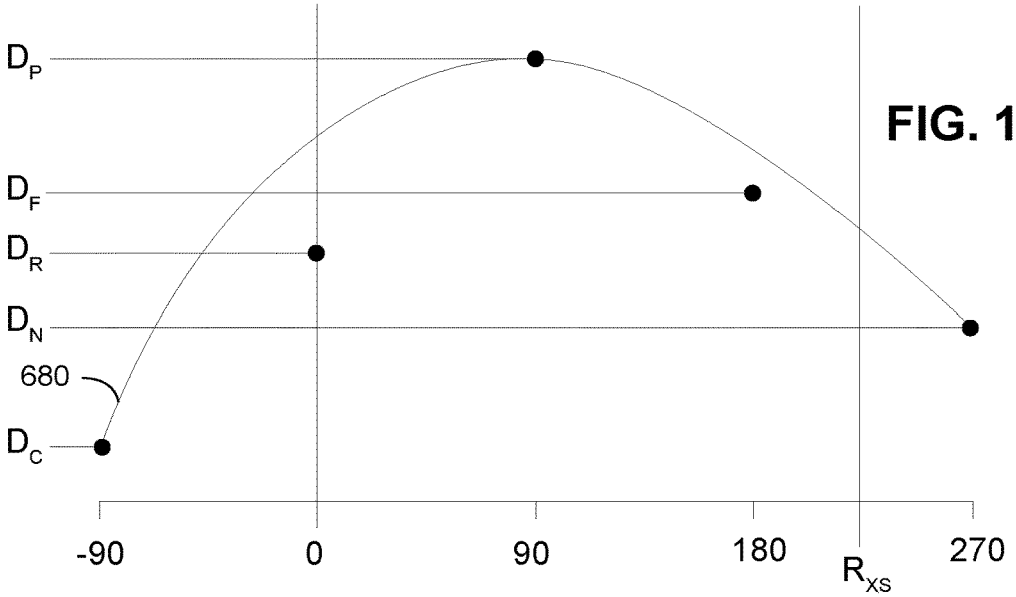
FIG. 16 illustrates a sub-portion of the portion of the demand curve of FIG. 13.

To facilitate an understanding of this concept, for example, FIG. 16 illustrates portion 680 of demand curve 390 horizontally stretched to position the corner contact angle for the current corner at −90 degrees, the corner contact angle for the next corner at 270 degrees, and the peak demand angle at 90 degrees. It will be appreciated that the degree in which portion 680 is stretched between the corner contact angle for the current corner and the peak demand angle may differ from the degree in which portion 680 is stretched between the peak demand angle and the corner contact angle for the next corner. In addition, it will be appreciated that in some embodiments, this "stretching" may be implemented simply through mathematical scaling The rising inflection point is positioned at a 0 degree rotational position (i.e., half way between the −90 degree rotational position for the current corner and the 90 degree rotational position for the peak demand angle) and the falling inflection point is positioned at a 180 degree rotational position (i.e., half way between the 90 degree rotational position for the peak demand angle and the 270 degree rotational position for the next corner). The demand value $D_R$ for the rising inflection point is $(D_P-D_C)/2$ and the demand value $D_F$ for the falling inflection point is $(D_P-D_N)/2$.

Figure 17:
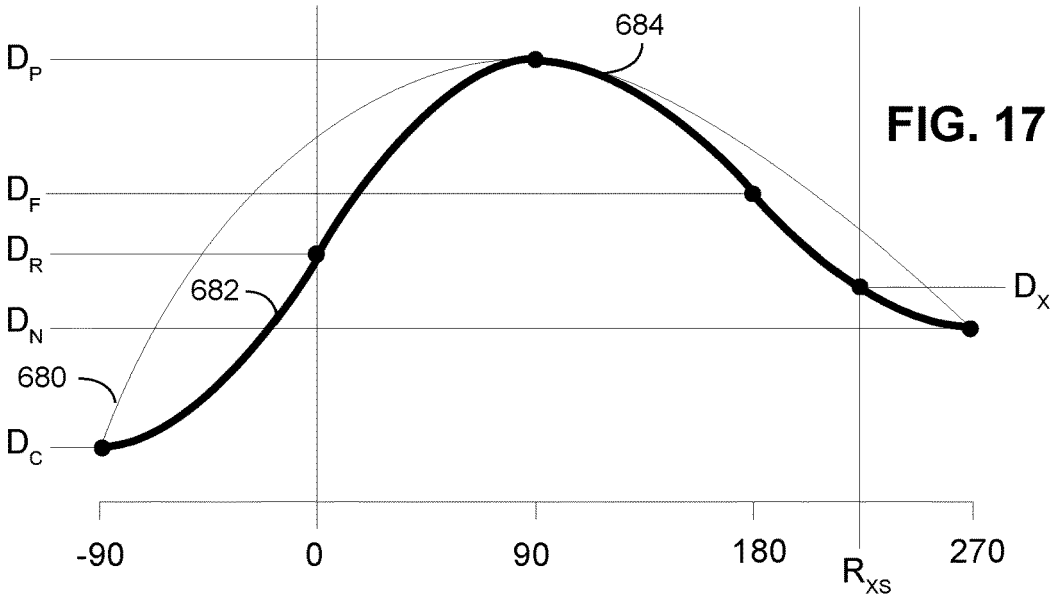
FIG. 17 illustrates a fitted curve superimposed on the sub-portion of FIG. 16.

FIG. 17 illustrates two quarter sine curves or segments 682, 684 respectively fit onto the rising and falling sub-portions of demand curve portion 680. For segment 682, a sinusoidal function (e.g., a sine function) is fit to the point corresponding to the current corner (−90, $D_C$), the rising inflection point (0, $D_R$) and the point corresponding to the peak demand (90, $D_P$), while for segment 684, a sinusoidal function (e.g., a sine function) is fit to the point corresponding to the point corresponding to the peak demand (90, $D_P$), the falling inflection point (0, $D_F$) and the point corresponding to the next corner (−90, $D_N$).

Now returning to FIG. 12, while in some embodiments curve fitting for both the rising and falling sub-portions of a demand curve portion may be performed (e.g., to generate both quarter sine curves 682, 684 of FIG. 17), in the illustrated embodiment, only one of the quarter sine curves may be fit for any particular rotational position. Thus, block 712 effectively determines which of the two quarter sine curves is generated.

As such, if the rotational position is before the peak demand angle, block 712 passes control to block 714 to determine the rising inflection point angle and corresponding demand value, and then to block 716 to fit a quarter sine curve segment (e.g., similar in shape to quarter sine curve 682) between the corner contact angle for the current corner, the rising inflection point and the peak demand angle. Otherwise, block 712 passes control to block 718 to determine the falling inflection point angle and corresponding demand value, and then to block 720 to fit a quarter sine curve segment (e.g., similar in shape to quarter sine curve 684) between the peak demand angle, the rising inflection point and the corner contact angle for the next corner. It will be appreciated that various manners may be used to fit a quarter sine curve to the aforementioned points, as will be apparent to those of ordinary skill having the benefit of the instant disclosure.

Upon completion of either block 716 or block 720, control then passes to block 722, where a demand value for the current rotational position is determined using the fit curve. FIG. 17, for example, illustrates a current rotational position $R_{XS}$ (which corresponds to the current rotational position $R_X$ scaled to the same relative position between peak demand angle $R_P$ and the corner contact angle $R_N$ for the next corner in the 180 degree range between the 90 and 270 degree positions illustrated in FIG. 17). The demand value at that current position is illustrated at $D_X$, the value of quarter sine curve 684 at rotational position $R_{XS}$.

Returning again to FIG. 12, once the demand value is determined in block 722, control passes to block 724 to scale the demand to represent a percentage of girth and determine the dispense rate from the determined percentage, the filtered rate signal, and the wrap force parameter. Control then passes to block 726 to control the packaging material dispenser to output packaging material at the determined dispense rate, whereby sequence 700 is then complete.

Various modifications may be made to sequence 700 in other embodiments. For example, different methodologies may be used to generate rising or falling inflection points, e.g., by using a point on a demand curve at a predetermined rotational position (e.g., half way between a corner contact angle and peak demand angle), or by using a point on a demand curve having a predetermined demand value (e.g., using the average of the demand values for the corner contact angle and the peak demand angle). Additional intermediate points may also be used for curve fitting in some embodiments, and in still other embodiments, other curves or functions, e.g., based on other trigonometric functions, polynomial functions, Gaussian functions, Lorentzian functions, Voigt functions, etc., may be used for curve fitting. Moreover, combinations of functions may be used in some embodiments to generate multiple segments of a curve that cover a portion of a relative revolution, a full relative revolution, or even multiple relative revolutions.

Figure 18:
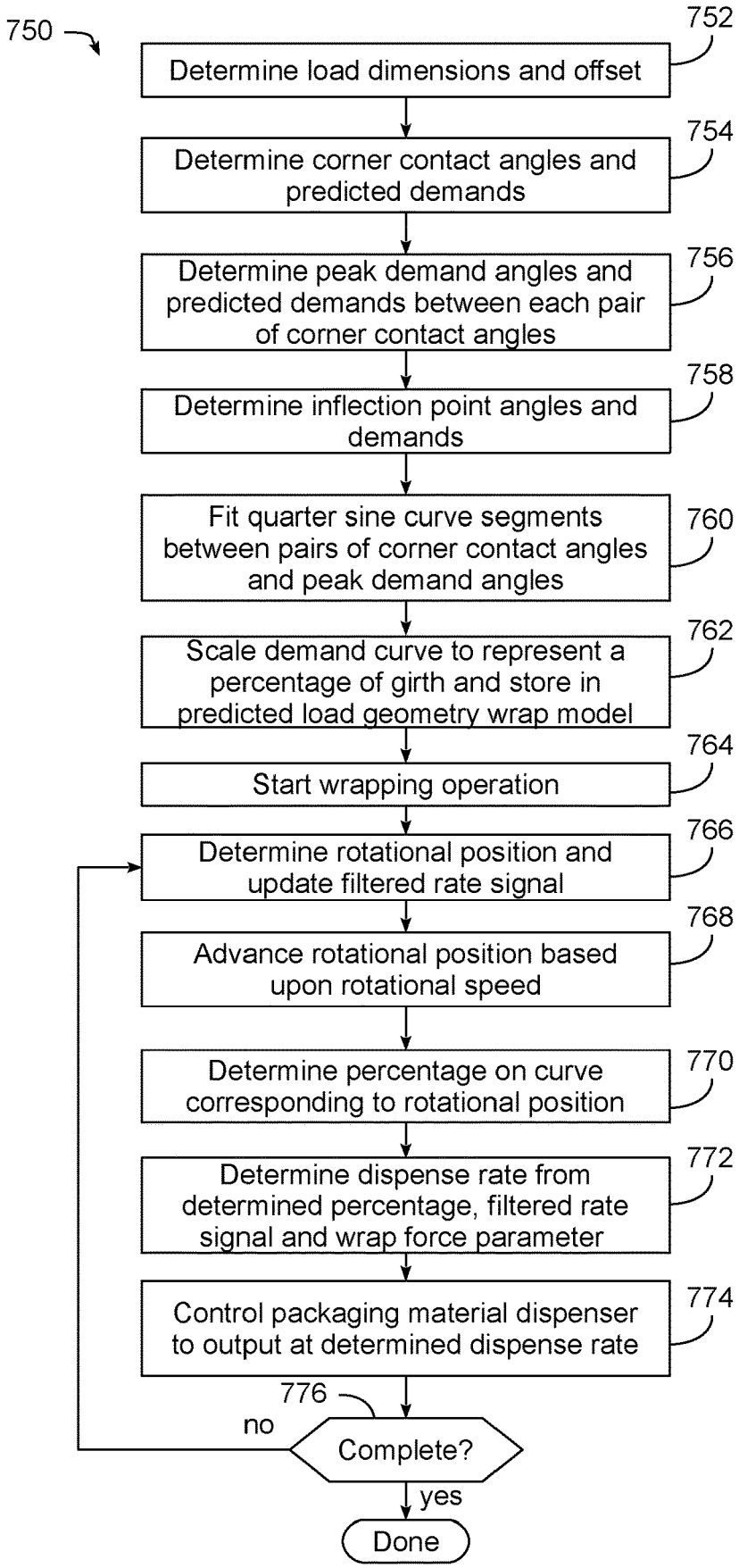
FIG. 18 is a flowchart illustrating another example sequence of operations for determining and controlling a dispense rate of a packaging material dispenser consistent with the invention.

In addition, as illustrated by sequence of operations 750 in FIG. 18, rather than performing curve fitting dynamically during a wrapping operation, curve fitting may be used in some embodiments to generate a demand curve for a load prior to performing a wrapping operation, which may then subsequently be accessed during the wrapping operation to determine a demand for use in generating a dispense rate for a particular rotational position. Sequence 750 begins in block 752 by determining load dimensions and an offset for a load, e.g., based upon input data or using one or more sensors configured to sense a load when being conveyed to a wrapping machine or when the load is ready to be wrapped.

Next, in block 754 corner contact angles and associated predicted demands are determined for all four corners. In some embodiments, the dimensions may also vary at different heights of the load, whereby different predicted demands may be determined for different heights of the load. Predicted demands may be determined in any of the various manners described above.

Next, in block 756 peak demand angles and predicted demands therefor are determined between each pair of corners of the load, e.g., in the various manners discussed above, resulting in the generation of four peak demand angles and associated predicted demands. Likewise, in block 758, four rising inflection points and four falling inflection points, and associated demands therefor, are determined using any of the various manners discussed above.

Next, in block 760, quarter sine curve segments are fit between pairs of corner contact angles and peak demand angles (generating a total of eight quarter sine curve segments) using any of the various manners discussed above. Then, in block 762, the resulting demand curve is scaled to represent a percentage of girth, and stored in a predicted load geometry wrap model in block 762.

Next, in block 764, the wrapping operation is started, and a loop is initiated in block 766 to control dispense rate during the wrapping operation. In block 766, the current rotational position for the load is determined. In addition, the filtered rate signal may be updated in block 766 (e.g., using Equation (1) discussed above), although it will be appreciated that in other embodiments, the filtered rate signal may be updated at a different rate and/or in a parallel process from the iteration of blocks 766-776.

Next, in block 768 the rotational position is optionally advanced based upon current rotational speed to offset system lag. Block 770 then determines a percentage for the current rotational position by accessing the stored curve in the predicted load geometry wrap model, and indexed based upon the current rotational position (optionally advanced to offset system lag). Next, in block 772, the dispense rate is determined from the determined percentage, the filtered rate signal and the wrap force parameter, e.g., using Equation (2) discussed above. Then, in block 774, the packaging material dispenser is controlled to output at the determined dispense rate. Block 776 then determines if wrapping is complete, and if not, returns control to block 766 to update the dispense rate for the next sensed rotational position of the load. Once wrapping is complete, however, block 776 terminates the sequence.

It will be appreciated that each of blocks 752-776 may be performed in various embodiments by a wrapping apparatus controller, by a cloud service, by a remote server, or by another external device. In other embodiments, however, various blocks may be implemented in different devices. For example, in one embodiment, blocks 752-762 may be performed externally from a wrapping apparatus controller to generate the predicted load geometry wrap model, and blocks 764-776 may be performed by a wrapping apparatus controller during a wrapping operation to retrieve percentage values from a predetermined curve stored in the wrap model.

Figure 19:
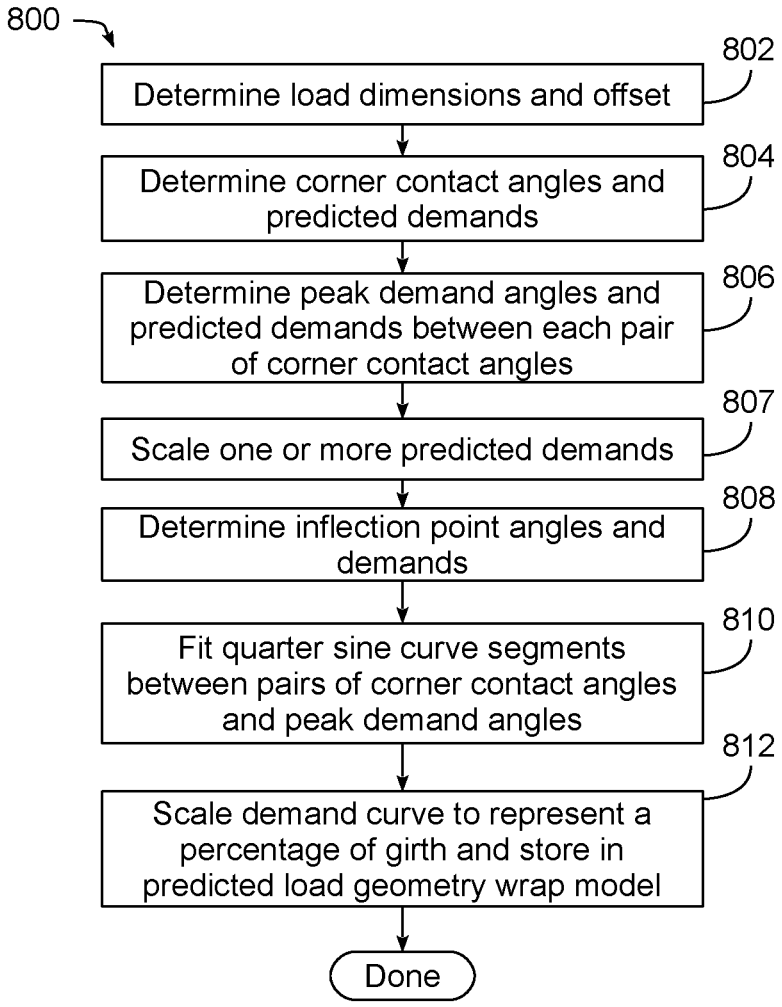
FIG. 19 is a flowchart illustrating another example sequence of operations for creating a wrap model consistent with the invention.

As another alternative, and as illustrated by sequence of operations 800 in FIG. 19, it may be desirable in some embodiments to scale predicted demands for one or more points utilized in a curve fitting operation. In particular, in some embodiments, it may be desirable to decrease the amplitude of a fit curve to "soften" the curve and reduce the total dispense rate change required for a packaging material dispenser. Blocks 802, 804, 806, 808, 810 and 812, for example, are identical to blocks 752, 754, 756, 758, 760 and 762 of sequence 750 of FIG. 18, but in sequence 800, an additional operation in block 807 may be used to scale one or more predicted demands prior to determining inflection points and fitting quarter sine curve segments for a demand curve. It will also be appreciated that such scaling may also be performed on a demand curve scaled as a percentage of girth in other embodiments.

Figure 20:
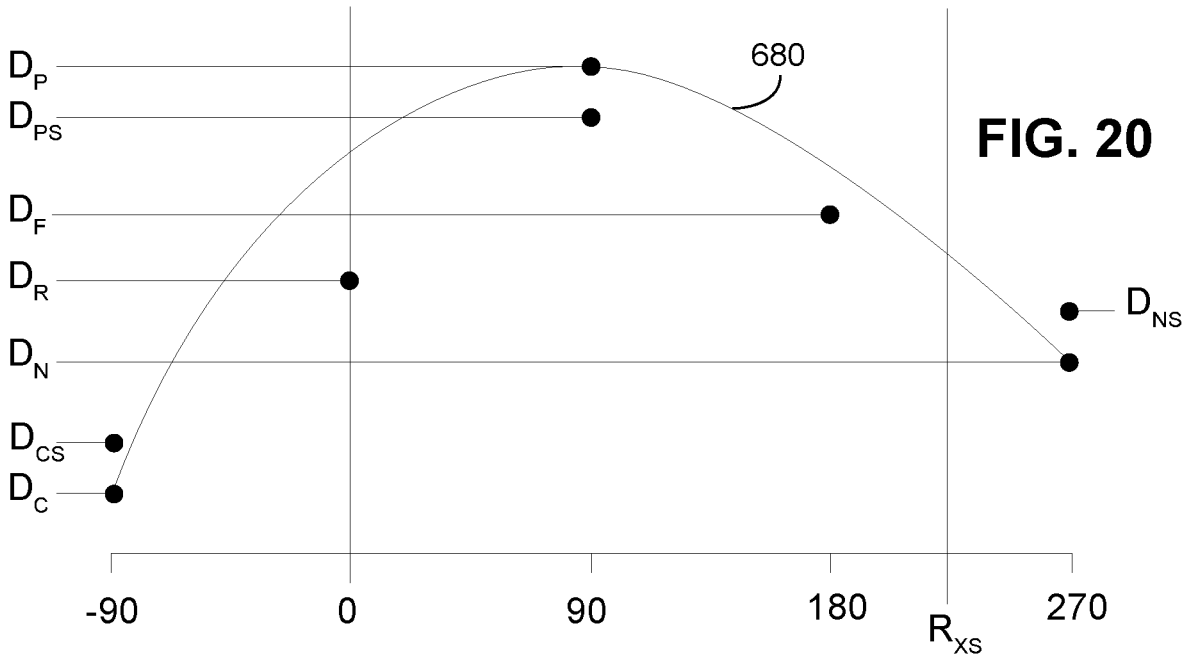
FIG. 20 illustrates the sub-portion of the demand curve of FIG. 16, with additional scaled demand values superimposed thereon.

Predicted demands may be scaled, for example, for one or more corner contact angles, one or more peak demand angles, one or more inflection points, etc., and the scaling may be used to increase or decrease the magnitude of the predicted demand. FIG. 20, for example, illustrates demand curve 680 in a similar manner as FIG. 16, but also illustrates additional scaled predicted demands for the current corner ($D_{CS}$), the next corner ($D_{NS}$) and the peak demand angle ($D_{PS}$). In this embodiment, the predicted demands for the corner contact angles are increased by X % and the predicted demand for the peak demand angle is decreased by X %, although it will be appreciated that different percentages may be used for each angle in other embodiments. In still other embodiments, only a subset of the predicted demands may be scaled, and in some embodiments, scaling may be performed via adding or subtracting a fixed offset rather than scaling by a percentage. In addition, while due to the fact that the same scaling is performed for all three angles illustrated in FIG. 20, the demand values for the inflection points do not change, in other embodiments the scaling of predicted demands may result in different demand values for the inflection points.

Figure 21:
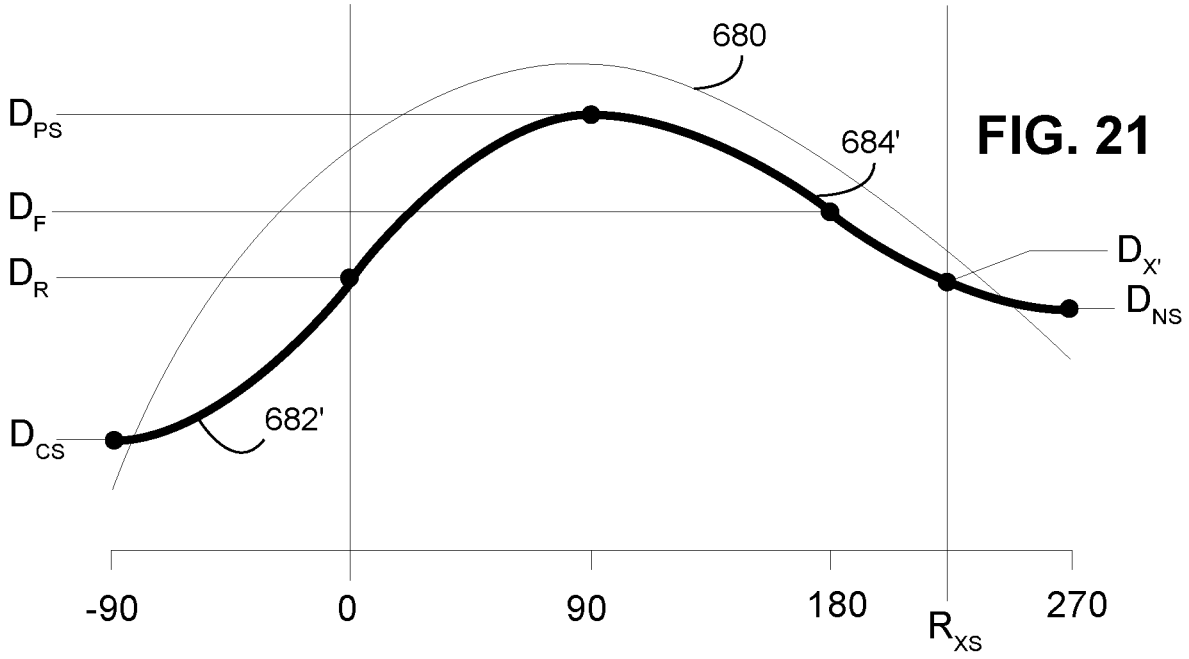
FIG. 21 illustrates a fitted curve superimposed on the sub-portion of FIG. 20.

FIG. 21 illustrates two quarter sine wave curve segments 682' and 684' that may be generated using the scaled predicted demands. As will be appreciated from a review of this figure as compared to FIG. 17, the magnitudes between the peaks and troughs of the fit curve segments 682' and 684' are smaller than for segments 682 and 684, resulting the packaging material dispenser varying within a reduced range of dispense rates. In addition, it will be appreciated that for the rotational angle represented by $R_{XS}$ the demand value output for controlling the packaging material dispenser (e.g., in the manner described above in connection with sequence 700) will shift to the demand value $D_{X'}$ relative to the demand value $D_X$ of FIG. 17.

It will be appreciated that scaled predicted demands may be utilized in connection with other manners of controlling dispense rate, e.g., sequence 700, among others. Further, other types of curves may be fit using scaled predicted demands in other embodiments.

The curve fitting utilized in the herein-described embodiments may be used in various manners to optimize the wrapping of a load. For example, in some embodiments it may be desirable to fit a curve that effectively decreases a rate of change in dispense rate relative to a dispense rate calculated based on predicted demand when the packaging material dispenser is transitioning between acceleration and deceleration. In some embodiments, it may also be desirable to do so proximate the corners of a load where changes in demand can be substantial once a next corner engages a web of packaging material.

Furthermore, when combined with a sensed rate of packaging material exiting the packaging material dispenser as described herein, a predicted wrap model for a standard type of load may be used to generate dispense rates based at least in part on the geometry of a load without having to sense or input the actual dimensions of the load, and with the sensed rate of the packaging material used to track the actual girth of the load during the wrapping process. Such techniques may be particularly useful, for example, in applications such as with automatic or semi-automatic stretch wrappers where sensing or inputting the actual dimensions for each and every load is not desirable, such that the dispense rate may be controlled simply based upon the input of load dimensions for a standard load type and sensing of an exit rate of the packaging material from the packaging material dispenser.

Other embodiments will be apparent to those skilled in the art from consideration of the specification and practice of the present invention. Therefore the invention lies in the claims set forth hereinafter.

What is claimed is:

1. A method of wrapping a load with packaging material using a wrapping apparatus of a type including a packaging material dispenser for dispensing packaging material to the load, the method comprising:

generating relative rotation between the packaging material dispenser and the load about a center of rotation;

sensing a rate of the packaging material exiting the packaging material dispenser; and controlling a dispense rate of the packaging material dispenser during the relative rotation based at least in part on a geometric relationship between the packaging material dispenser and a calculated location of at least one corner of the load within a plane perpendicular to the center of rotation, and further based at least in part on the sensed rate of the packaging material exiting the packaging material dispenser, wherein the calculated location of the at least one corner is calculated independent of the sensed rate of packaging material exiting the packaging material dispenser.

2. The method of claim 1, wherein the at least one corner includes a first corner, the method further comprising calculating the position of the first corner based at least in part upon one or more dimensions of the load.

3. The method of claim 2, wherein the one or more dimensions includes a length and a width.

4. The method of claim 2, wherein the one or more dimensions are input by an operator.

5. The method of claim 2, wherein the one or more dimensions are sensed by one or more sensors directed at the load.

6. The method of claim 2, wherein the one or more dimensions are retrieved from a wrap profile stored in the wrapping apparatus.

7. The method of claim 2, wherein the one or more dimensions are based at least in part upon a standard load type representative of the load, and wherein the one or more dimensions are determined without sensing the one or more dimensions from the load and without receiving input from an operator or a wrap profile specific to the load.

8. The method of claim 2, wherein calculating the position of the first corner is further based at least in part upon an offset of the load from the center of rotation.

9. The method of claim 8, wherein the offset is based at least in part upon a standard load type representative of the load, and wherein the offset is determined without sensing the offset from the load and without receiving input from an operator or a wrap profile specific to the load.

10. The method of claim 1, wherein the packaging material dispenser includes a pre-stretch assembly, and wherein sensing the rate of the packaging material exiting the packaging material dispenser includes sensing rotation of an idle roller disposed downstream of the pre-stretch assembly.

11. The method of claim 10, wherein the idle roller forms an exit point for the packaging material dispenser.

12. A method of wrapping a load with packaging material using a wrapping apparatus of a type including a packaging material dispenser for dispensing packaging material to the load, the method comprising:

generating relative rotation between the packaging material dispenser and the load about a center of rotation;

sensing a rate of the packaging material exiting the packaging material dispenser; and controlling a dispense rate of the packaging material dispenser during the relative rotation based at least in part on a geometric relationship between the packaging material dispenser and a calculated location of at least one corner of the load within a plane perpendicular to the center of rotation, and further based at least in part on the sensed rate of the packaging material exiting the packaging material dispenser, wherein the at least one corner of the load includes a first corner, and wherein controlling the dispense rate of the packaging material dispenser includes determining a demand at a first rotational position about the center of rotation using a curve fit between second and third rotational positions that are respectively before and after the first rotational position about the center of rotation and for which predicted demands are determined.

13. The method of claim 12, wherein controlling the dispense rate of the packaging material dispenser further includes determining the predicted demands for the second and third rotational positions based at least in part upon the calculated position for the first corner.

14. The method of claim 13, wherein the curve is a demand curve defining a demand at each of a plurality of rotational positions between the second and third rotational positions, and wherein controlling the dispense rate further includes determining the first dispense rate by scaling a demand from the demand curve based at least in part upon a wrap force parameter.

15. The method of claim 12, wherein the curve defines, for each of a plurality of rotational positions, a percentage of a girth of a standard load type representative of the load.

16. The method of claim 12, wherein the curve defines, for each of a plurality of rotational positions, a percentage of a girth of the load, wherein the girth of the load is based upon input of one or more dimensions of the load.

17. The method of claim 12, wherein the curve includes a portion of a sinusoidal curve fit between the second and third rotational positions.

18. The method of claim 12, further comprising determining the first dispense rate at the first rotational position further by applying a rotational data shift to offset system lag.

19. The method of claim 18, wherein the rotational data shift is variable based at least in part upon a rate of relative rotation between the packaging material dispenser and the load.

20. The method of claim 12, wherein the curve includes a plurality of segments spanning a full revolution about the center of rotation, each segment fit between two or more rotational positions for which predicted demands are determined.

21. The method of claim 20, wherein each segment includes a sine curve fit between two or more rotational positions for which predicted demands are determined.

22. The method of claim 20, wherein the plurality of segments includes eight segments, each of the eight segments spanning between a rotational position associated with a local minimum in demand and a rotational position associated with a local maximum in demand.

23. A method of wrapping a load with packaging material using a wrapping apparatus of a type including a packaging material dispenser for dispensing packaging material to the load, the method comprising:

generating relative rotation between the packaging material dispenser and the load about a center of rotation;

sensing a rate of the packaging material exiting the packaging material dispenser; and controlling a dispense rate of the packaging material dispenser during the relative rotation based at least in part on a geometric relationship between the packaging material dispenser and a calculated location of at least one corner of the load within a plane perpendicular to the center of rotation, and further based at least in part on the sensed rate of the packaging material exiting the packaging material dispenser, wherein controlling the dispense rate of the packaging material dispenser based at least in part on the sensed rate of the packaging material exiting the packaging material dispenser includes generating a signal from the sensed rate that varies based upon an actual girth of the load at an elevation at which the packaging material dispenser is dispensing packaging material to the load.

24. The method of claim 23, wherein controlling the dispense rate of the packaging material dispenser based at least in part on the geometric relationship between the packaging material dispenser and the calculated location of at least one corner of the load includes determining a demand at a first rotational position about the center of rotation.

25. The method of claim 24, wherein controlling the dispense rate of the packaging material dispenser based at least in part on the sensed rate of the packaging material includes scaling the determined demand based at least in part upon the generated signal.

26. The method of claim 24, wherein controlling the dispense rate of the packaging material dispenser based at least in part on the geometric relationship between the packaging material dispenser and the calculated location of at least one corner of the load further includes determining a percentage of girth of the load from the determined demand, and wherein controlling the dispense rate of the packaging material dispenser based at least in part on the sensed rate of the packaging material includes scaling the generated signal by the determined percentage of girth.

27. The method of claim 23, wherein controlling the dispense rate of the packaging material dispenser based at least in part on the geometric relationship between the packaging material dispenser and the calculated location of at least one corner of the load includes generating a curve for a plurality of rotational positions about the center of rotation.

28. The method of claim 27, wherein the curve is a demand curve defining a demand for each of the plurality of rotational positions, and wherein controlling the dispense rate of the packaging material dispenser based at least in part on the sensed rate of the packaging material includes scaling the curve based at least in part upon the generated signal.

29. The method of claim 27, wherein the curve is a curve defining a percentage of girth for each of the plurality of rotational positions, and wherein controlling the dispense rate of the packaging material dispenser based at least in part on the sensed rate of the packaging material includes scaling the generated signal based at least in part upon the curve.

30. The method of claim 25, wherein the at least one corner of the load includes a first corner, and wherein controlling the dispense rate of the packaging material dispenser includes determining a first demand at a first rotational position about the center of rotation using the curve, and wherein the curve is fit between second and third rotational positions that are respectively before and after the first rotational position about the center of rotation and for which predicted demands are determined.

31. The method of claim 23, wherein generating the signal includes sampling the sensed rate of the packaging material exiting the packaging material dispenser at a plurality of intervals and applying a filter to the samples.

32. The method of claim 23, wherein generating the signal includes sampling the sensed rate of the packaging material exiting the packaging material dispenser at a plurality of intervals and, at each interval, summing a first percentage of the sampled sense rate with a second percentage of value calculated during a prior interval.

33. A method of wrapping a load with packaging material using a wrapping apparatus of the type including a packaging material dispenser for dispensing packaging material to the load, the method comprising:

generating relative rotation between the packaging material dispenser and the load about a center of rotation;

sensing a rate of the packaging material exiting the packaging material dispenser; and controlling a dispense rate of the packaging material dispenser during the relative rotation, wherein controlling the dispense rate includes:

generating a curve that varies over at least a portion of a relative revolution about the center of rotation based at least in part upon one or more dimensions of the load within a plane perpendicular to the center of rotation, wherein generating the curve is performed independent of the sensed rate of packaging material exiting the packaging material dispenser;

at a first rotational position, generating a dispenser control signal by combining a value of the curve corresponding to the first rotational position with the sensed rate of the packaging material exiting the packaging material dispenser; and using the dispenser control signal to control the dispense rate of the packaging material dispenser.

34. The method of claim 33, wherein the curve defines a plurality of values each representing a percentage of a girth of the load at an associated rotational position, and wherein combining the value of the curve corresponding to the first rotational position with the sensed rate of the packaging material exiting the packaging material dispenser comprises scaling the sensed rate of the packaging material exiting the packaging material dispenser by the value of the curve corresponding to the first rotational position.

35. The method of claim 34, further comprising generating the sensed rate of the packaging material exiting the packaging material dispenser by sampling a rate of rotation of an encoder coupled to an idle roller downstream of a pre-stretch assembly of the packaging material dispenser at each of a plurality of intervals and averaging sampled rates captured over multiple intervals.

36. The method of claim 33, wherein controlling the dispense rate further comprises applying a wrap force parameter such that the dispenser control signal is scaled by the wrap force parameter.

37. The method of claim 33, wherein controlling the dispense rate further comprises applying a rotational data shift such that the dispenser control signal is shifted to offset system lag.

38. A method of wrapping a load with packaging material using a wrapping apparatus of the type including a packaging material dispenser for dispensing packaging material to the load during relative rotation between the packaging material dispenser and the load about a center of rotation, the method comprising:

prior to initiating a wrap cycle for the load, receiving operator input specifying one or more dimensions of the load within a plane perpendicular to the center of rotation;

determining a wrap model for the load based upon the one or more dimensions specified by the received operator input, the wrap model being representative of a demand for the packaging material dispenser over at least a portion of a revolution between the packaging material dispenser and the load based upon the one or more dimensions specified by the received operator input;

initiating the wrap cycle for the load and generating relative rotation between the packaging material dispenser and the load about the center of rotation;

sensing a rate of the packaging material exiting the packaging material dispenser with a sensor during the relative rotation and generating a signal representative thereof; and controlling the dispense rate of the packaging material dispenser during the relative rotation by scaling the generated signal at a first rotational position based upon the wrap model.

39. The method of claim 38, wherein the wrap model represents demand in terms of percentage of load girth over the at least a portion of the revolution.

40. The method of claim 38, wherein the wrap model defines a curve including a plurality of values, each representing a percentage of a girth of the load at an associated rotational position, and wherein scaling the generated signal at the first rotational position based upon the wrap model includes scaling the generated signal by the value of the curve corresponding to the first rotational position.

41. The method of claim 38, further comprising generating the signal by sampling a rate of rotation of an encoder coupled to an idle roller downstream of a pre-stretch assembly of the packaging material dispenser at each of a plurality of intervals and averaging sampled rates captured over multiple intervals.

42. The method of claim 38, wherein controlling the dispense rate further comprises applying a wrap force parameter such that the dispense rate is scaled by the wrap force parameter.

43. The method of claim 38, wherein controlling the dispense rate further comprises applying a rotational data shift such that the dispense rate is shifted to offset system lag.

44. An apparatus for wrapping a load with packaging material, the apparatus comprising:

a packaging material dispenser for dispensing packaging material to the load, the packaging material dispenser including a pre-stretch assembly and an idle roller downstream of the pre-stretch assembly;

a rotational drive configured to generate relative rotation between the packaging material dispenser and the load about a center of rotation;

an encoder configured to sense rotation of the idle roller and output a signal representative thereof; and a controller coupled to the packaging material dispenser, the rotational drive and the sensor, the controller configured to control a dispense rate of the packaging material dispenser during the relative rotation by:

generating a filtered rate signal at least in part by averaging together a plurality of samples of the encoder signal; and scaling the filtered rate signal by a value determined based at least in part on a geometric relationship between the packaging material dispenser and a calculated location of at least one corner of the load within a plane perpendicular to the center of rotation.

45. The apparatus of claim 44, wherein the controller is further configured to determine the value by accessing a wrap model that defines a curve representative of a demand for the packaging material dispenser over at least a portion of a revolution between the packaging material dispenser and the load based upon one or more dimensions of the load.

46. The apparatus of claim 45, wherein the wrap model represents demand in terms of percentage of load girth over the at least a portion of the revolution.

47. The apparatus of claim 46, wherein the wrap model includes a rotational data shift to offset system lag.

48. The apparatus of claim 44, wherein the controller is further configured to control the dispense rate further by applying a wrap force parameter such that the dispense rate is scaled by the wrap force parameter.

* * * * *